US006425170B1

(12) United States Patent
Zirps et al.

(10) Patent No.: US 6,425,170 B1
(45) Date of Patent: Jul. 30, 2002

(54) RIVET SETTING TOOL WITH JAW GUIDE AND NOSE HOUSING QUICK CONNECT

(75) Inventors: Christopher T. Zirps, Sharon; Joshua P. Kinsley, Arlington, both of MA (US); Donald J. Donofrio, III, Hamden; Theodore S. Komsta, Shelton, both of CT (US); David J. Banducci, Saunderstown, RI (US)

(73) Assignee: Emhart LLC, Newark, DE (US)

( * ) Notice: Subject to any disclaimer, the term of this patent is extended or adjusted under 35 U.S.C. 154(b) by 0 days.

(21) Appl. No.: 09/873,619

(22) Filed: Jun. 4, 2001

(51) Int. Cl.[7] ..... B21J 15/20
(52) U.S. Cl. ..... 29/243.525; 29/243.523
(58) Field of Search ..... 29/243.521, 243.523, 29/243.524, 243.525

(56) References Cited

U.S. PATENT DOCUMENTS

| | | | | |
|---|---|---|---|---|
| 3,254,522 A | | 6/1966 | Elliott et al. | |
| 3,309,911 A | | 3/1967 | Simmons | |
| 3,399,561 A | | 9/1968 | Martin | |
| 3,406,557 A | | 10/1968 | Harris | |
| 3,412,594 A | | 11/1968 | Lund | |
| 3,657,915 A | | 4/1972 | Lee | |
| 3,777,540 A | | 12/1973 | Siebol et al. | |
| 3,991,601 A | | 11/1976 | Duncan | |
| 4,027,520 A | | 6/1977 | Klein | |
| 4,130,006 A | | 12/1978 | Ebbert et al. | |
| 4,454,746 A | | 6/1984 | Schwab | |
| 4,462,240 A | | 7/1984 | Yamamoto | |
| 4,489,471 A | | 12/1984 | Gregory | |
| 4,546,637 A | | 10/1985 | Elias | |
| 4,580,435 A | | 4/1986 | Port et al. | |
| 4,604,889 A | | 8/1986 | Sukharevsky | |
| 4,628,722 A | | 12/1986 | Mauer et al. | |
| 4,630,460 A | | 12/1986 | Mauer | |
| 4,744,238 A | | 5/1988 | Halbert | |
| 4,770,023 A | | 9/1988 | Schwab | |
| 4,989,442 A | | 2/1991 | Rosier | |
| 5,060,359 A | | 10/1991 | Muir | |
| 5,086,551 A | | 2/1992 | Shamaly et al. | |
| 5,123,162 A | | 6/1992 | Wing et al. | |
| 5,170,923 A | | 12/1992 | Dear et al. | |
| 5,207,085 A | | 5/1993 | Hopkins et al. | |
| 5,323,946 A | * | 6/1994 | O'Connor et al. | 29/243.525 |
| 5,337,463 A | | 8/1994 | Rossler et al. | |
| 5,351,392 A | | 10/1994 | Wing et al. | |
| 5,519,926 A | | 5/1996 | Rosier | |
| 5,598,619 A | * | 2/1997 | Rosier | 29/243.523 |
| 5,647,209 A | | 7/1997 | Wilcox | |
| 5,694,671 A | | 12/1997 | Frearson et al. | |
| 5,697,136 A | | 12/1997 | Frearson et al. | |
| 5,697,137 A | | 12/1997 | Frearson et al. | |
| 5,752,305 A | | 5/1998 | Cotterill et al. | |
| 6,014,801 A | | 1/2000 | Wilcox | |

* cited by examiner

*Primary Examiner*—David Jones
(74) *Attorney, Agent, or Firm*—Harness, Dickey & Pierce, P.L.C.

(57) ABSTRACT

A rivet setting tool is provided with a quick connect jaw guide assembly and nose housing. The quick connect feature allows for quicker easier disassembly and assembly of the jaw guide assembly and nose housing for cleaning and general maintenance.

12 Claims, 19 Drawing Sheets

FIG 3
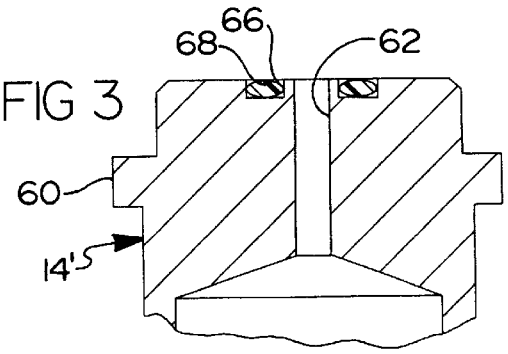
FIG 4
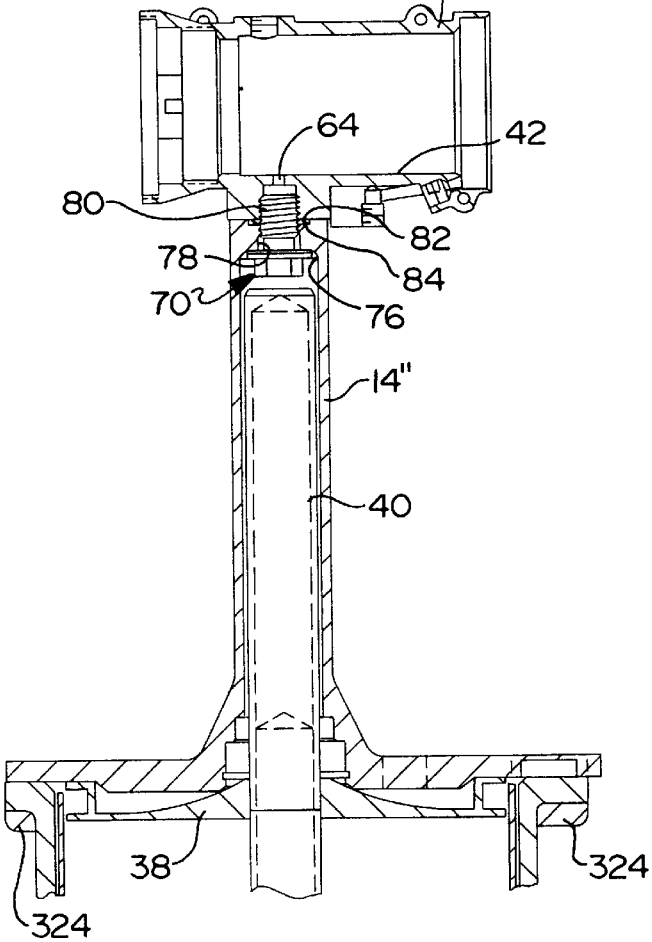
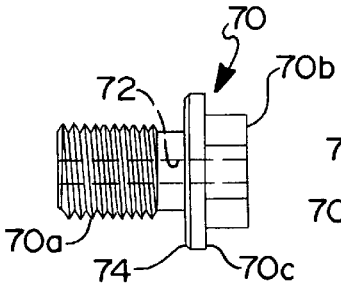
FIG 5a
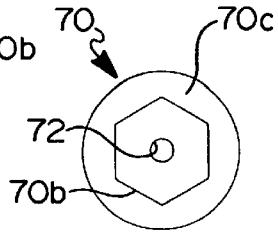
FIG 5b

FIG 7
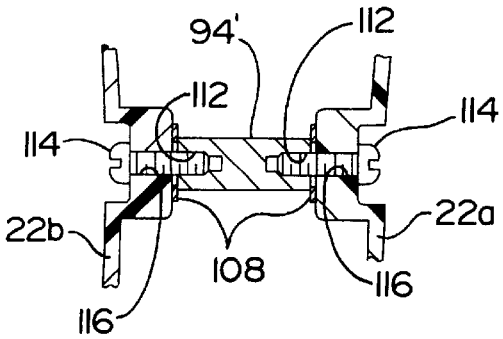
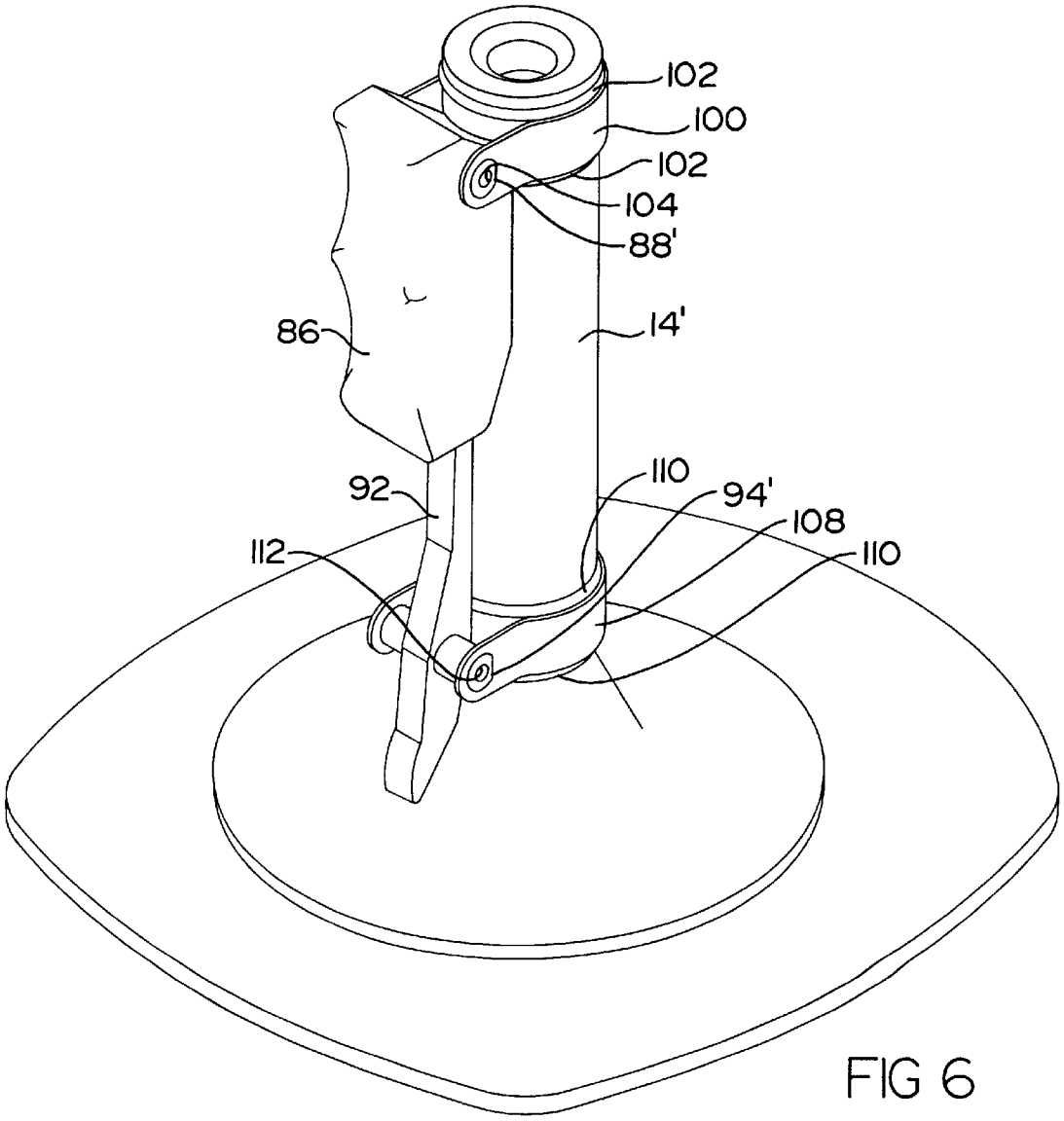
FIG 6

FIG 9
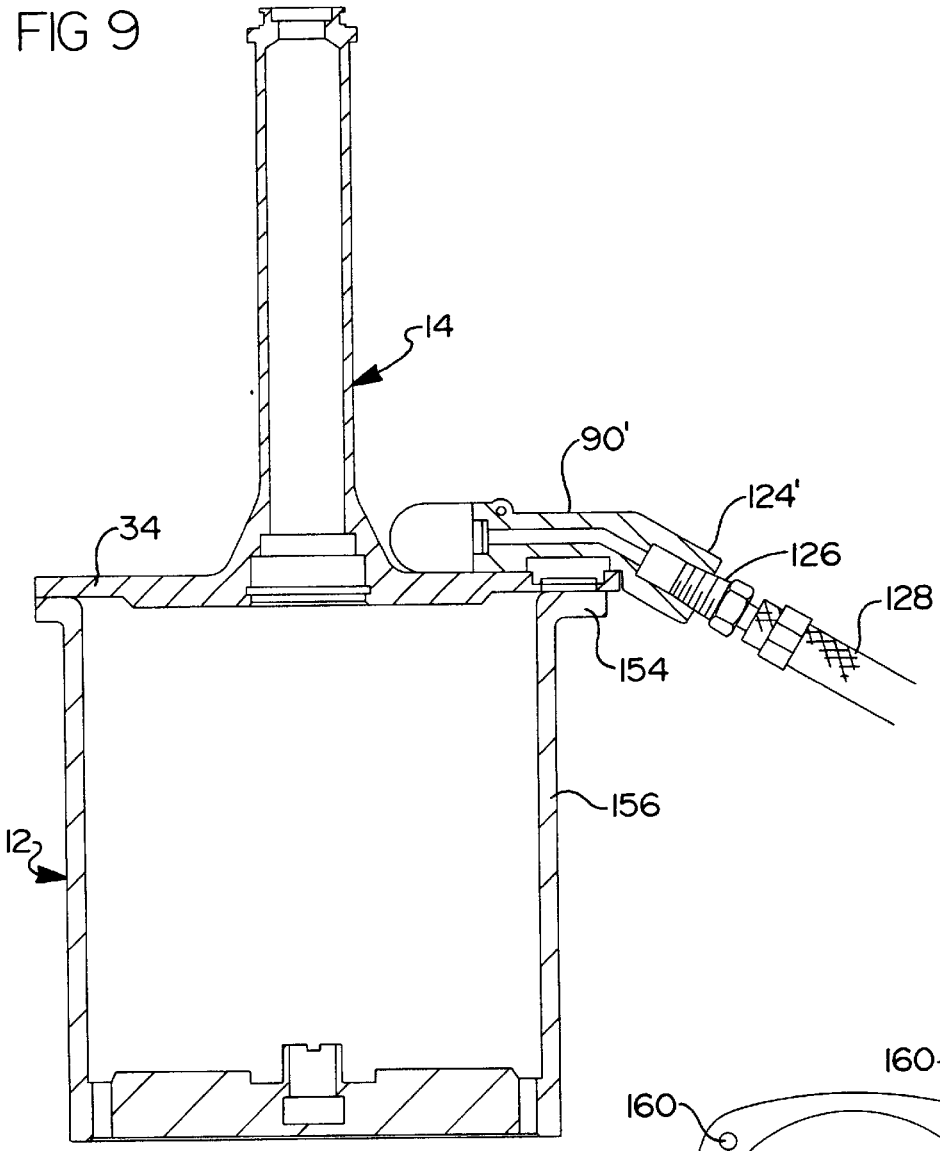
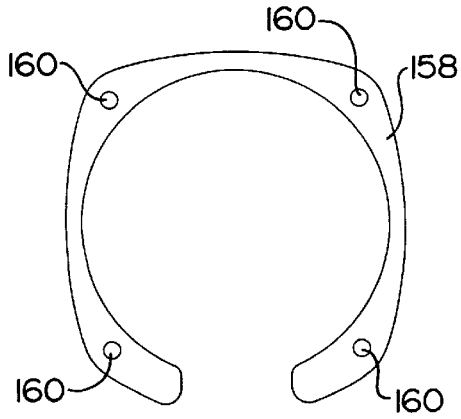
FIG 10

FIG 15
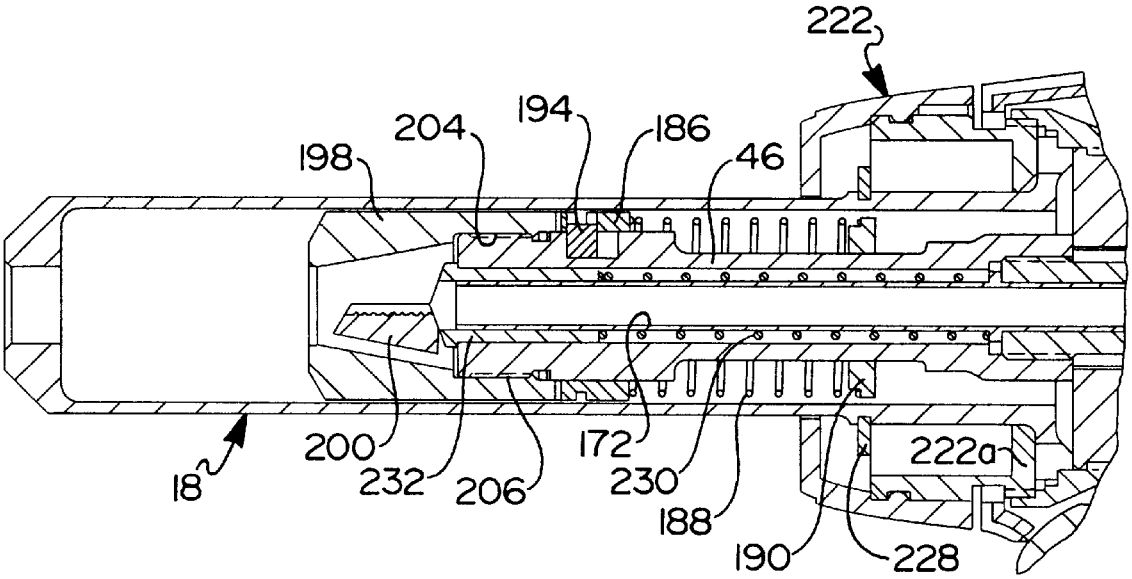
FIG 14
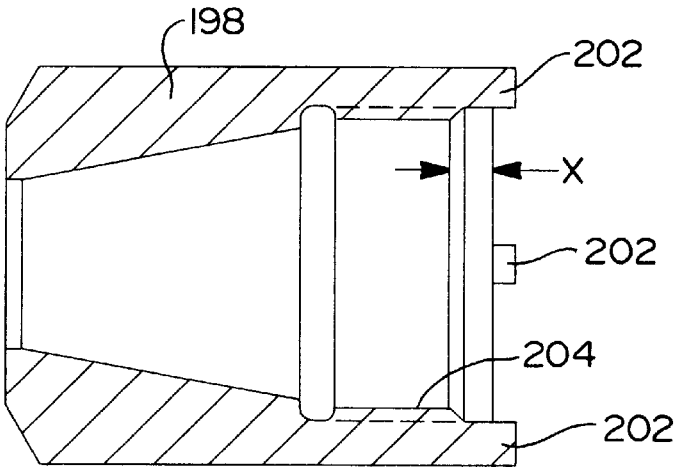
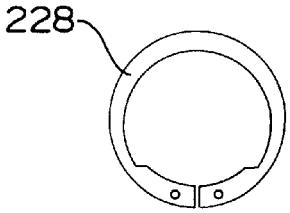
FIG 16

FIG 24
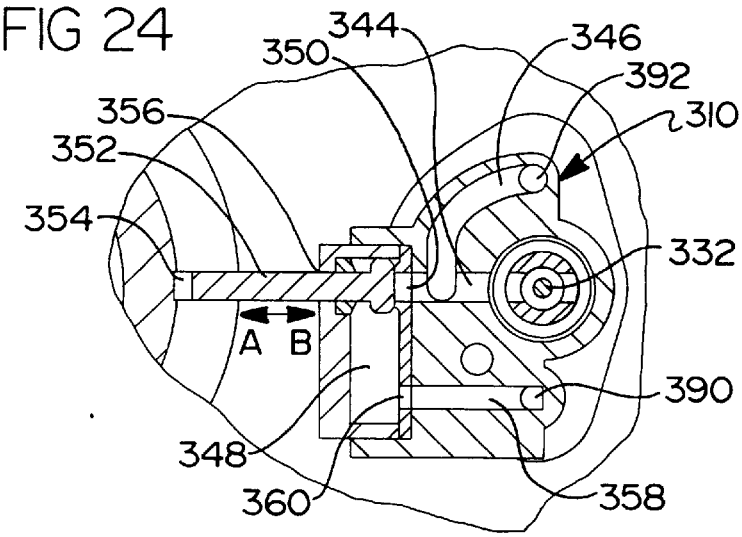
FIG 26a
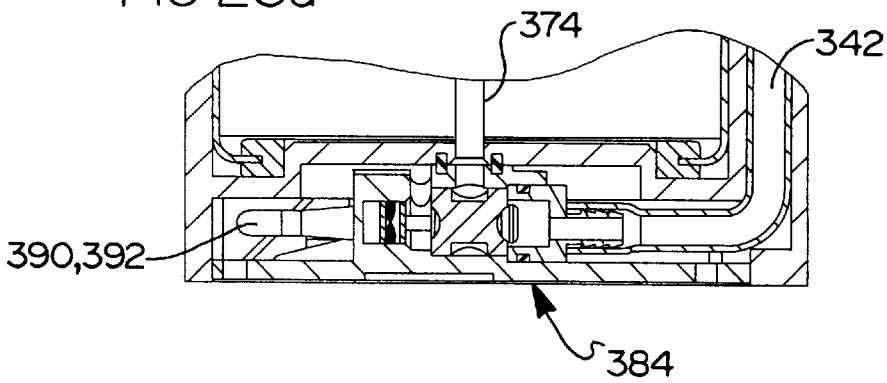
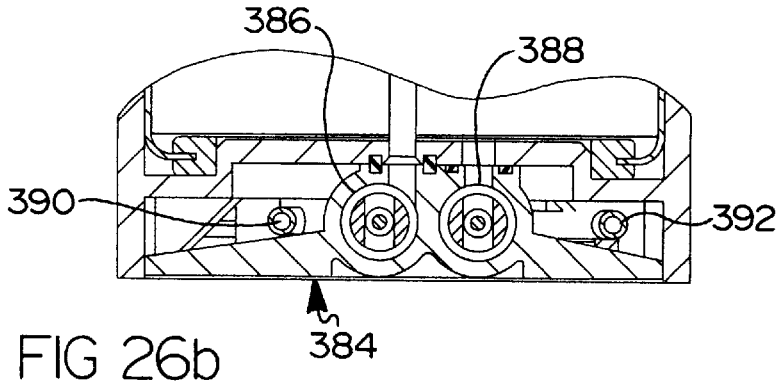
FIG 26b

RIVET SETTING TOOL WITH JAW GUIDE AND NOSE HOUSING QUICK CONNECT

FIELD OF THE INVENTION

The present invention relates generally to rivet setting tools, and more particularly to a quick connect jaw guide and nose housing for a rivet setting tool.

BACKGROUND

Various types of rivet setting tools are known in the industry. Some include spring actuated, pneumatically actuated, hydraulically actuated systems and combinations thereof. As rivet setting tools have developed, manufacturers strive to improve the efficiency, reduce the complexity and increase an operator's ease in handling the tool.

Rivets are available in varying sizes dependent upon the rivet strength required. Therefore, varying sizes of rivet setting tools are required to set each size of rivet. Maintaining multiple rivet setting tools requires more cost and storage space than is desirable. Throughout a rivet setting tool's lifetime, dirt and debris also tend to inhibit the tools ability to perform properly and therefore require periodic maintenance. Maintenance (e.g. cleaning, part replacement) of such rivet setting tools is cumbersome as such tools tend to be mechanically complex and difficult to disassemble.

It is therefore desirable in the industry to provide a rivet setting tool which can be quickly adapted for varying sizes of rivets and easily disassembled for cleaning and general maintenance. It is an object of the present invention to provide a nose housing and jaw guide assembly for a rivet setting tool which is easily disassembled from the rivet setting tool and is interchangeable with varying sizes of nose housings and jaw guide assemblies to accommodate varying sizes of rivets.

SUMMARY OF THE INVENTION

The present invention provides a rivet setting tool comprising a pulling head assembly which includes a piston disposed within a cylinder. The piston is operative for actuating a plurality of jaw members for applying an axial pulling force to a mandrel of a rivet. The jaw guide assembly includes a first member connected to the piston, for movement with the piston. A jaw guide collar is slidably disposed on the first member and is biased in a first direction by a spring member. A jaw guide module supports the plurality of jaw members and is threadedly engaged with the first member. The jaw guide collar and jaw guide module have a ratcheting interface therebetween, such that the jaw guide collar must be pulled against the biasing force of the spring member to disengage it with the jaw guide module. The jaw guide module may then be unscrewed from the first member. The housing is also provided with a quick connect feature including anti-rotation recesses mating with anti rotation tabs on the housing. A nut assembly threadedly engages tool housing to secure the nose housing thereto.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 3 is a cross-sectional view of an alternative arrangement of the intensifier cylinder;

FIG. 4 is a cross-sectional of a third arrangement of mounting the housing to the intensifier cylinder;

FIGS. 5*a* and 5*b* are side and rear views, respectively, of a threaded fastener used in the arrangement of FIG. 4;

FIG. 6 is a perspective view of an alternative mounting arrangement of the trigger;

FIG. 7 is a cross-sectional view illustrating the mounting of the housing halves to the trigger and lever mounts;

FIG. 9 is a cross-sectional view of an alternative air source interface integrally formed with the valve module;

FIG. 10 is a plan view of a clamp plate according to the present invention;

FIG. 14 is a cross-sectional view of the jaw guide;

FIG. 15 is a cross-sectional view of the jaw guide assembly and nose housing;

FIG. 16 is a plan view of a clip used for retaining the nose knob on the nose housing;

FIG. 24 is a cross sectional view of the pilot valve assembly taken along line 24–24 of FIG. 23;

FIGS. 26*a* and 26*b* are cross sectional views of a valve module of the second preferred embodiment;

DETAILED DESCRIPTION OF THE PREFERRED EMBODIMENTS

Figure 1:
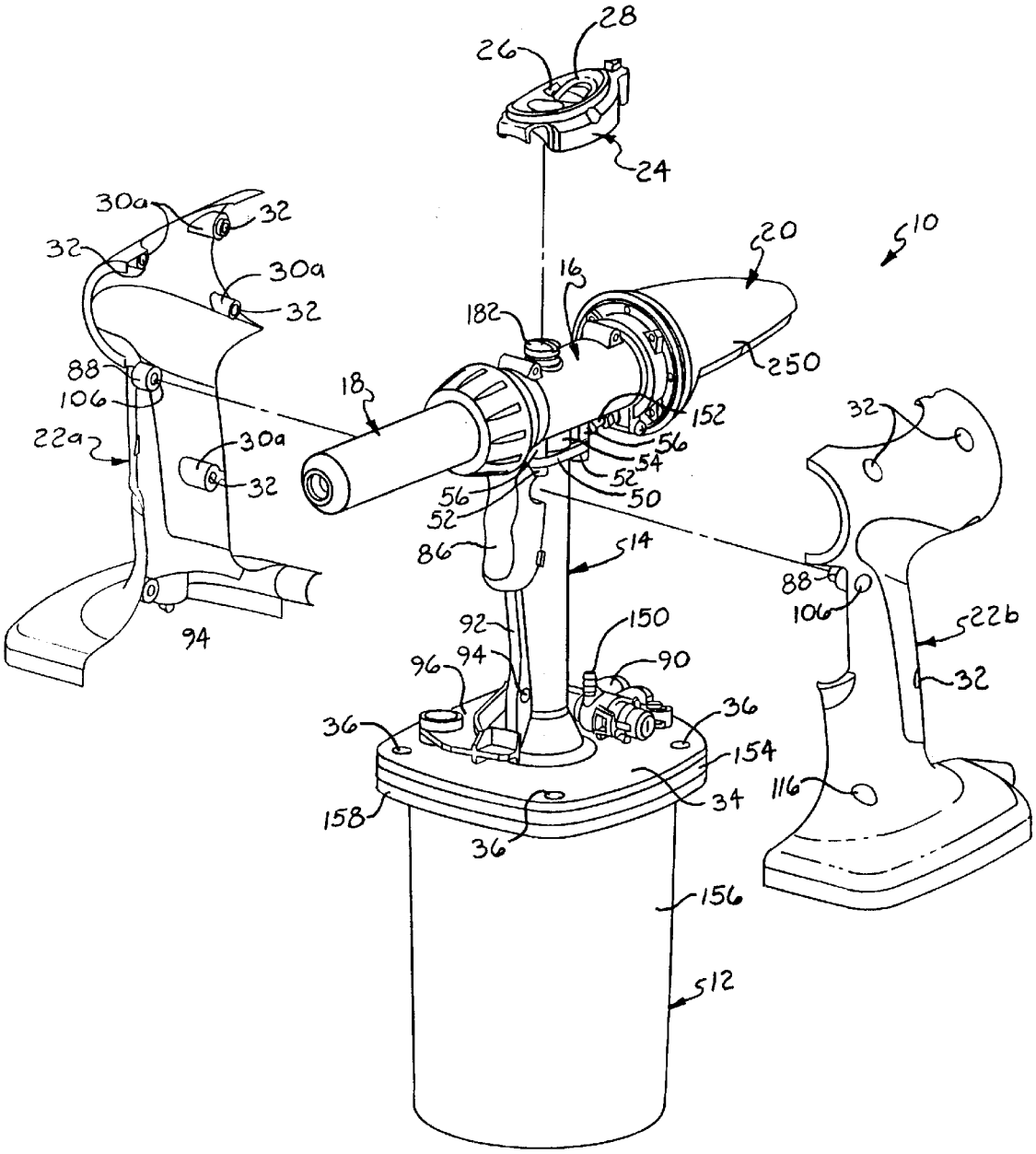
FIG. 1 is a partially exploded perspective view of a rivet setting tool according to the principles of the present invention.

With reference to FIG. 1, an exploded view of rivet setting tool 10 is shown. Rivet setting tool 10 includes pneumatic chamber 12, cylinder 14, housing 16, nose housing 18, and mandrel collection system 20. Rivet setting tool 10 also comprises first and second plastic housing halves 22*a,b* and plastic cover 24. Cover 24 defines a hanger well 26 which supports a hanger 28 therein. First and second plastic housing halves 22*a,b* include a plurality of alignment bosses 30*a,b*. Alignment bosses 30*a* of plastic housing half 22*a*, align and mate with alignment bosses 30*b* of plastic housing half 22*b*. Each alignment boss 30*a,b* has a hole 32 therethrough, for receiving a screw or bolt (not shown). In this manner, plastic housing halves 22*a,b* attach to each other, thus enclosing rivet setting tool 10. A top plate (intensifier plate) 34 which covers the pneumatic chamber 12 has a hole 36 disposed at each corner. The housing 16 includes bosses 37 which are also utilized in combination with bosses 30*a,b* for attaching the plastic housing halves 22*a,b* to the housing 16.

Figure 2:
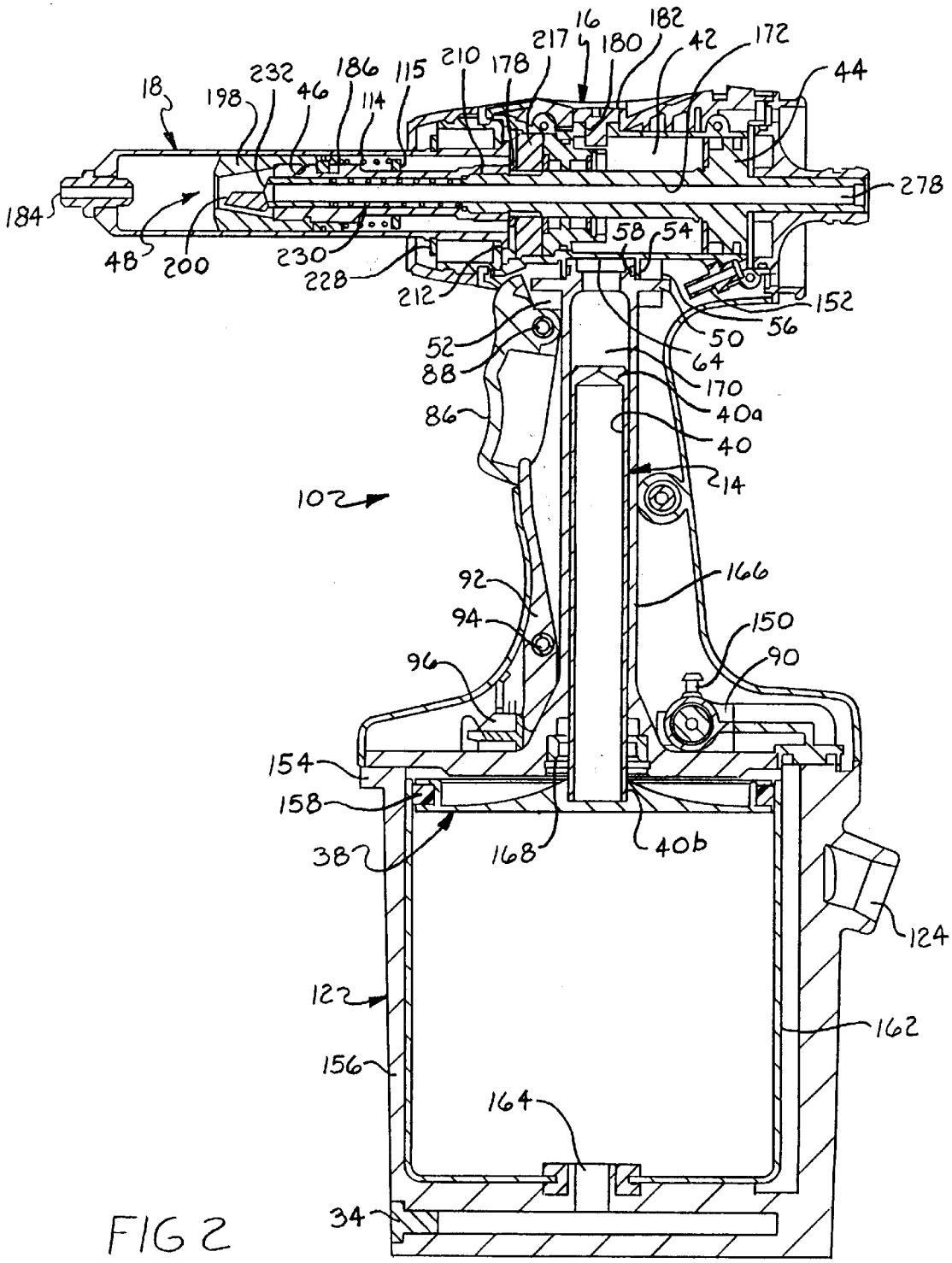
FIG. 2 is a cross sectional view of the rivet setting tool.

With reference to FIG. 2, pneumatic chamber 12 is provided with a piston 38 which is connected to a rod 40 disposed within the cylinder 14. The cylinder 14 is filled with a generally incompressible fluid and is in communication with a working chamber 42 disposed within housing 16. A piston 44 is disposed within working chamber 42 for reciprocating movement therein. Piston 44 is attached to a pulling head adapter 46 of a jaw guide assembly 48. During operation, pressurized gas is supplied to the pneumatic chamber 12 driving the piston 38 and rod 40 upward. Rod 40 displaces the incompressible fluid in cylinder 14 causing the fluid to enter the working chamber 42. The fluid entering the working chamber 42 drives the working piston 44 rearward which activates the jaw guide assembly 48 to engage and set a rivet.

As shown in FIGS. 1 and 2, the cylinder 14 is provided with an upper flange portion 50 which extends radially outwardly from the upper end of the cylinder 14. The upper flange portion 50 is provided with four corners each having a hole therein for receiving a bolt 52 for mounting the cylinder 14 to the housing 16. The housing 16 includes a generally cylindrical flange portion 54 which receives the upper end of cylinder 14 and abuts against the upper flange portion 50 of the cylinder 14. The housing 16 further includes four mounting bosses 56 which correspond with the four corners of the upper flange portion 50 of the cylinder 14 and threadedly receive the bolts 52 provided through the holes in the upper flange portion 50. An O-ring seal 58 is disposed in a groove around an outer surface of the upper end of the cylinder 14 and disposed against an inner surface of the cylindrical flange portion 54 of the housing 16.

Alternatively, the upper end of the cylinder 14' can be configured as shown in FIG. 3. The cylinder 14' includes a flange portion 60 similar to the upper flange portion 50 described above with respect to FIGS. 1 and 2. The flange portion 60 includes four holes for mounting the cylinder 14' to the housing 16 as described with regard to the embodiment of FIGS. 1 and 2. The primary differences of the embodiment of FIG. 3 is that the upper end of the cylinder 14' is provided with a narrow passage 62, i.e., approximately the same size as an opening 64 which communicates with the working chamber 42 disposed within housing 16. A recessed groove 66 is disposed adjacent to the narrow passage 62 and receives an O-ring seal 68 which is disposed between the cylinder 14' and housing 16. Because the surface area radially inside of the O-ring is relatively small, the forces applied by the hydraulic fluid that tends to separate the cylinder 14' from the housing 16 is reduced. In other words, since the surface area is reduced, the force is also reduced. According to experimental results, the configuration of FIG. 3 reduced the pushing apart force from approximately 1700 pounds (for the embodiment of FIGS. 1 and 2) to approximately 200 pounds.

A third embodiment of the present invention is shown in FIG. 4 wherein the cylinder 14" is mounted to the housing 16' in yet another manner. Specifically, the cylinder 14" is secured to the housing 16' by a threaded fastener 70. As best shown in FIGS. 5*a* and 5*b*, the threaded fastener 70 includes a threaded shank portion 70*a*, a hex head portion 70*b* and a radially extending flange portion 70*c* disposed between the shank 70*a* and the head portion 70*b*. The threaded fastener 70 includes a fluid passage 72 extending therethrough along a central axis thereof. The flange portion 70*c* includes a radiused outer edge 74 which is disposed against a radiused inner surface 76 of the cylinder 14". The cylinder 14" includes an opening 78 in an upper end thereof for receiving the threaded shank portion 70*a* therethrough.

The threaded shank portion 70*a* of threaded fastener 70 is engaged with an internally threaded bore 80 disposed in the housing 16'. The housing 16' includes an opening 64 which communicates with the working chamber 42 disposed within housing 16'. The upper end of cylinder 14" is provided with a recessed groove 82 which receives an O-ring seal 84 disposed adjacent to the shank portion 70*a* of the threaded fastener 70. The assembly of FIG. 4 allows the housing 16' to be assembled to the cylinder 14" with a single fastener 70 and greatly reduces the complexity of the manufacture of the cylinder 14" and housing 16'. The pushing apart force for the embodiment of FIG. 4 is also reduced since the area inside the O-ring seal 84 is reduced. The radiused outer edge 74 of the flange portion 70*c* also reduces the stresses on flange portion 70*c* and the cylinder 14".

With reference to FIGS. 1 and 2, a first preferred embodiment of rivet setting tool 10 will be described. Rivet setting tool 10 includes a trigger 86 mounted on and pivotable about mount 88. A valve module 90 is activated by trigger 86. When an operator depresses trigger 86, it acts upon a first vertical lever 92. Vertical lever 92 is mounted on and pivotable about mount 94. Vertical lever 92, being acted upon by trigger 86 further acts upon a second horizontal lever 96, best shown in FIG. 1. Horizontal lever 96 is pivotally mounted on top face 34 (i.e., the intensifier plate) of pneumatic chamber 12 and is in mechanical communication with valve module 90. When horizontal lever 96 is acted upon, it in turn acts upon valve module 90.

Alternative to the embodiment shown in FIGS. 1 and 2, the trigger 86 and lever 92 can be mounted as shown in FIGS. 6 and 7. In FIG. 6, the trigger 86 is mounted to the cylinder 14' by a mounting strap 100 which is received between a pair of grooves 102 in the exterior surface of the cylinder 14'. The ends of the mounting strap 100 receive a mount 88' which pivotally supports the trigger 86. The mount 88' has a threaded opening 104 disposed at each end for receiving a threaded fastener which is inserted through the holes 106 (FIG. 1) in the housing halves 22*a*, 22*b*. Likewise, the lever 92 is mounted to the cylinder 14' by a mounting strap 108 which is received between a pair of grooves 110 in the exterior surface of the cylinder 14'. The ends of the mounting strap 108 receive a mount 94'. which pivotally supports the lever 92. The mount 94'has a threaded opening 112 disposed at each end for receiving a threaded fastener 114 which is inserted through the holes 116 in the housing halves 22*a*, 22*b*, as best illustrated in FIG. 7. The alternative mounting arrangement for the trigger 86 and lever 92 shown in FIGS. 6 and 7 provides a support structure connected to both the cylinder 14 and the housing halves 22*a*, 22*b*.

Figure 8:
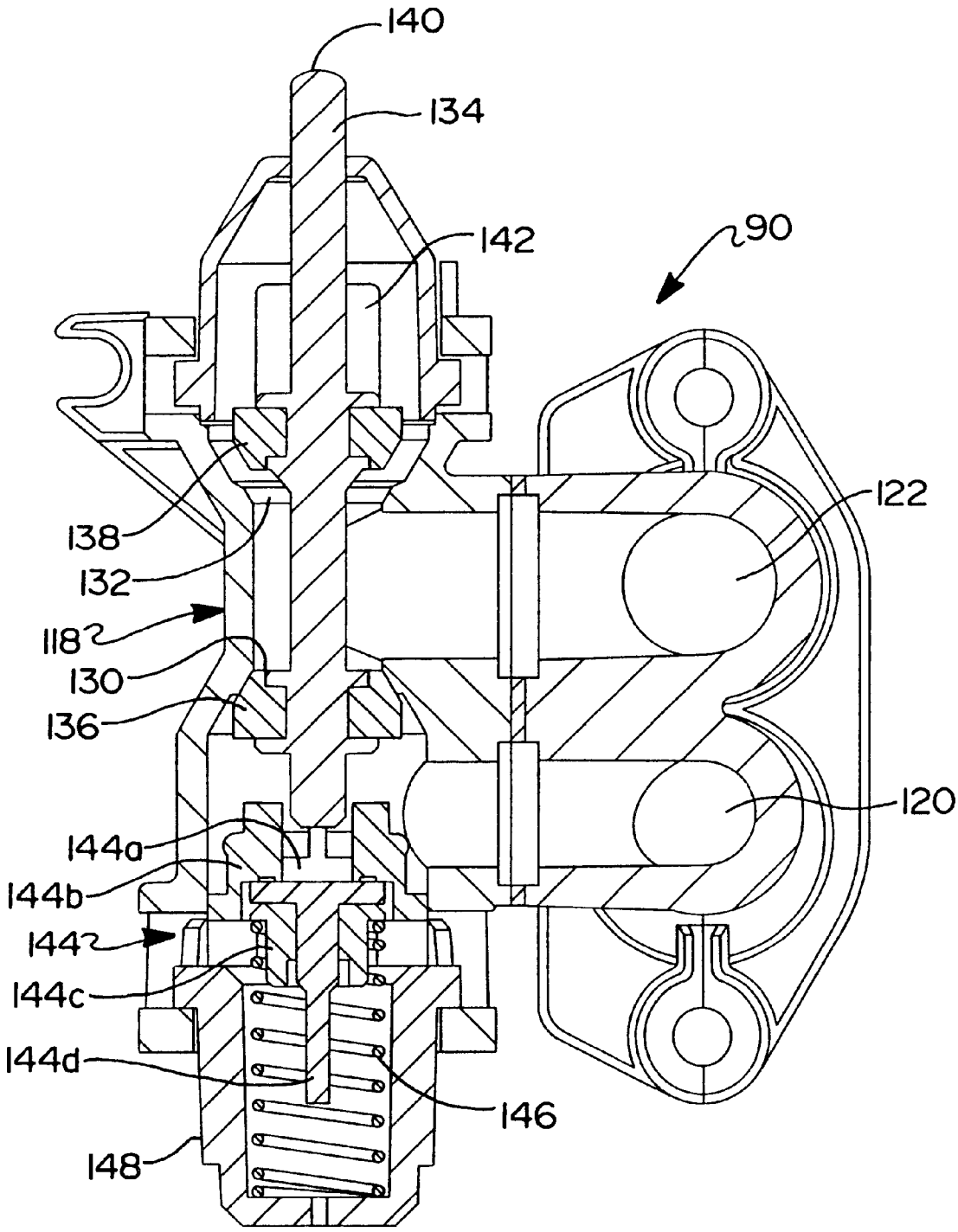
FIG. 8 is a cross sectional view of a valve module of the rivet setting tool.

With particular reference to FIG. 8, valve module 90 includes a main housing 118 having a supply air inlet 120 and an outlet 122. Supply air inlet 120 is connected to a pressurized air source interface 124, as best seen in FIG. 2, through a tubing (not shown). Alternatively, the air source interface 124' can be integrally formed with the valve module 90' as shown in FIG. 9. The air source interface 124' receives a threaded adapter 126 for mating with an air supply hose 128. Again with reference to FIG. 8, outlet 122 is connected to pneumatic chamber 12 for supplying pressurized air into pneumatic chamber 12. Main housing 118 is formed to provide first and second airflow paths 130,132. A spool member 134 is disposed through first and second airflow paths 130,132. Spool member 134 has first and second spools 136,138 for selectively blocking airflow paths 130,132, respectively. Spool member 134 is biased toward a first position as shown in FIG. 8 by the air pressure from the air inlet 120. When spool member 134 is in this first position, first spool 136 blocks first airflow path 130, and second airflow path 132 is open.

Horizontal lever 96 is in contact with an end face 140 of spool member 134. When horizontal lever 96 is acted upon, as described above, it in turn acts upon spool member 134, pushing spool member 134 into a second position. In the second position, second spool 138 blocks second airflow path 132 and first spool 136 is sufficiently moved to open first airflow path 130. As such, pressurized air is able to flow from an external air source (not shown), through inlet 120, first airflow path 130 and outlet 122 and into pneumatic chamber 12 as will be described in greater detail herein.

Once riveting action has taken place, the operator releases trigger 86 and the pressure of air from supply air inlet 120 biases spool member 134 back to its first position and the compressed air which had acted within pneumatic chamber 12, as will be described below, is exhausted through passage 132. This exhaustion of compressed air is required to allow piston 38 in pneumatic chamber 12 to return to a start position in preparation for subsequent riveting action. To achieve exhaustion, piston 38 in pneumatic chamber 12 forces the compressed air back through outlet 122, in a manner described below, back through valve module 90. With spool member 134 now in its first position, second spool 138 is not blocking second airflow path 132. As such, the air flows through second airflow path 132 and out a portal 142, which exhausts down around pneumatic chamber 12 through passages (not shown), and then to atmosphere. After this has occurred, rivet setting tool 10 is ready to again repeat the riveting process.

Valve module 90 includes a pressure relief valve 144, best shown in FIG. 8. Pressure relief valve 144 includes a relief exhaust port 144*a* disposed through a relief seat member 144*b*. A relief spool 144*c* is biased in a direction of relief seat member 144*b* by spring 146. A relief poppet seal 144d is supported by relief spool 144*c* and normally rests against relief seat member 144*b*. A relief cover 148 is attached to main housing 118 of valve module 90. Cover 148 supports spring 146 in compression against relief spool 144*c*. Pressure relief valve 144 is provided to relieve the pressure supplied through supply air inlet 120 when the pressure exceeds a predetermined level in order to ensure consistent operation even if the source of pressurized gas exceeds the predetermined desired pressure level. When the pressure of air passing by the pressure relief valve 144 exceeds the spring force of spring 146, the relief poppet seal 144*d* is pushed backward against the spring force to allow air to be exhausted by the pressure relief valve 144.

Again referencing FIGS. 1 and 2, valve module 90 includes an outlet 150. Outlet 150 is continuously fed with pressurized air by inlet 120 (FIG. 8). A system inlet 152 is disposed beneath housing 16 for supplying system air to housing 16 and mandrel collection system 20. System inlet 152 is connected to outlet 150 via a tube (not shown).

Again referencing FIGS. 1 and 2, pneumatic chamber 12 is substantially cylindrical in shape. According to a preferred embodiment, the pneumatic chamber 12 includes a mounting flange 154 extending radially outward from an upper edge of the cylindrical body 156. The mounting flange 154 is disposed against a lower surface of the top plate 34. A "C" shaped clamp plate 158, best shown in FIG. 10, is disposed below the mounting flange 154 of the pneumatic chamber 12. The "C" shaped clamp plate 158 is preferably made of a rigid metal and includes four holes 160 for receiving a threaded fastener upward from a bottom surface thereof and through a hole (not shown) in the mounting flange 154 and into threaded holes 36 in the top plate 34 in order to sandwich the mounting flange 154 between the top plate 34 and the "C" shaped clamp plate 158. According to a preferred embodiment, the pneumatic chamber 12 is made from plastic and the sandwich arrangement of the "C" shaped clamp plate 158 and the top plate 34 provide a distribution of stresses so that the pneumatic chamber 12 is sufficiently held in place without stress concentrations in the mounting flange 154.

In a first preferred embodiment, pneumatic chamber 12 includes a chamber sleeve 162 and piston 38 (best shown in FIG. 2). Chamber sleeve 162 and piston 38 interface such that a seal is produced between the two. In this manner, the pneumatic air required for producing the actuation force on piston 38 does not escape between chamber sleeve 162 and piston 38. As described above, pressurized air flows into pneumatic chamber 12 from valve module 90. An inlet 164, at the base of pneumatic chamber 12 is in communication with outlet 122 of valve module 90. As compressed air is forced into pneumatic chamber 12, through inlet 164, the compressed air acts on piston 38, forcing it upward. Piston 38 is connected to rod 40, which is housed within an intensifier cylinder 166. An intensifier seal 168 seals between intensifier cylinder 166 and rod 40. As piston 38 of the pneumatic actuation device is forced upward, rod 40 is also forced upward.

With further reference to FIG. 2, intensifier cylinder 166 defines a first chamber 170. Rod 40 is slidable within first chamber 170. First chamber 170 is filled with substantially incompressible fluid and has an opening 64 at an upper end thereof. Opening 64 enables fluid flow between first chamber 170 and working chamber 42, defined within housing 16. As rod 40 is forced upward through first chamber 170 the overall volume of first chamber 170 is reduced. As such, the substantially incompressible fluid is forced through opening 64, into working chamber 42. Concentrically disposed within working chamber 42 is a mandrel tube 172. Piston 44 is concentrically disposed around and slidable along mandrel tube 172. Piston 44 seals with working chamber 42 such that fluid is unable to flow between piston 44 and working chamber 42 and the substantially incompressible fluid remains on only one side of piston 44.

Figure 11:
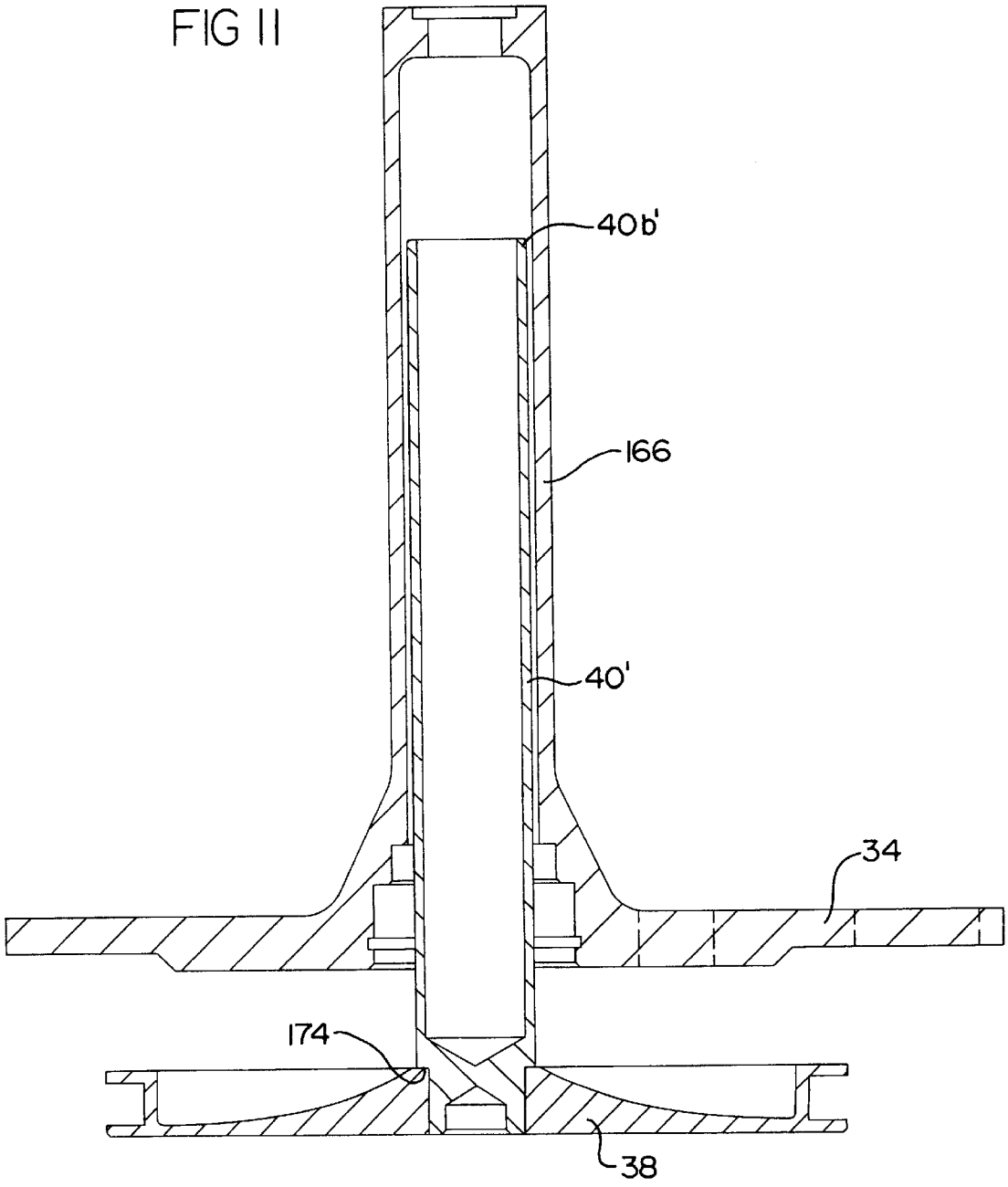
FIG. 11 is a cross-sectional view illustrating an alternative embodiment of the pneumatic piston and rod of the present invention.

As shown in FIG. 2, the rod 40 is provided with a closed upper end 40*a* and an open lower end 40*b* which is received in a recess in piston 38. According to an alternative embodiment, as shown in FIG. 11, the rod 40' can be modified to have its open end 40*b*' at the upper end and its closed end 40*a*' at the lower end. The rod 40' is full of hydraulic fluid which allows for the use of a greater volume of fluid which aids in heat transfer from the housing 16. In addition, the fluid has more surface contact with the rod 40' which is connected to the piston 38. Thus, there is greater heat transfer with the fluid and rod 40'. As shown in FIG. 11, the rod 40' has its closed end 40*a*' received in a bore centrally located in the piston 38. The closed end 40*a*' includes a shoulder 174 that is disposed against the piston 38.

Initially, prior to upward movement of rod 40, piston 44 is in a first forward position (FIG. 12) within working chamber 42. The first position is defined as piston 44 being located at the nose housing 18 end of working chamber 42, against a stopper 176. Stopper 176 is provided within working chamber 42 to prevent piston 44 from covering opening 64 when in its first position. While piston 44 is in its first position (FIG. 12), jaw guide assembly 48 is in an open position, prepared for riveting action. As rod 40 is forced upward and the substantially incompressible fluid is forced through opening 64, piston 44 is forcibly moved to a second rearward position, as shown in FIG. 2. Piston 44 is in mechanical communication with jaw guide assembly 48, via pulling head adapter 46 which is fixedly attached to piston 44 and is both concentric about and slidable along mandrel tube 172. The movement of piston 44 thus causes riveting action within nose housing 18.

Figure 12:
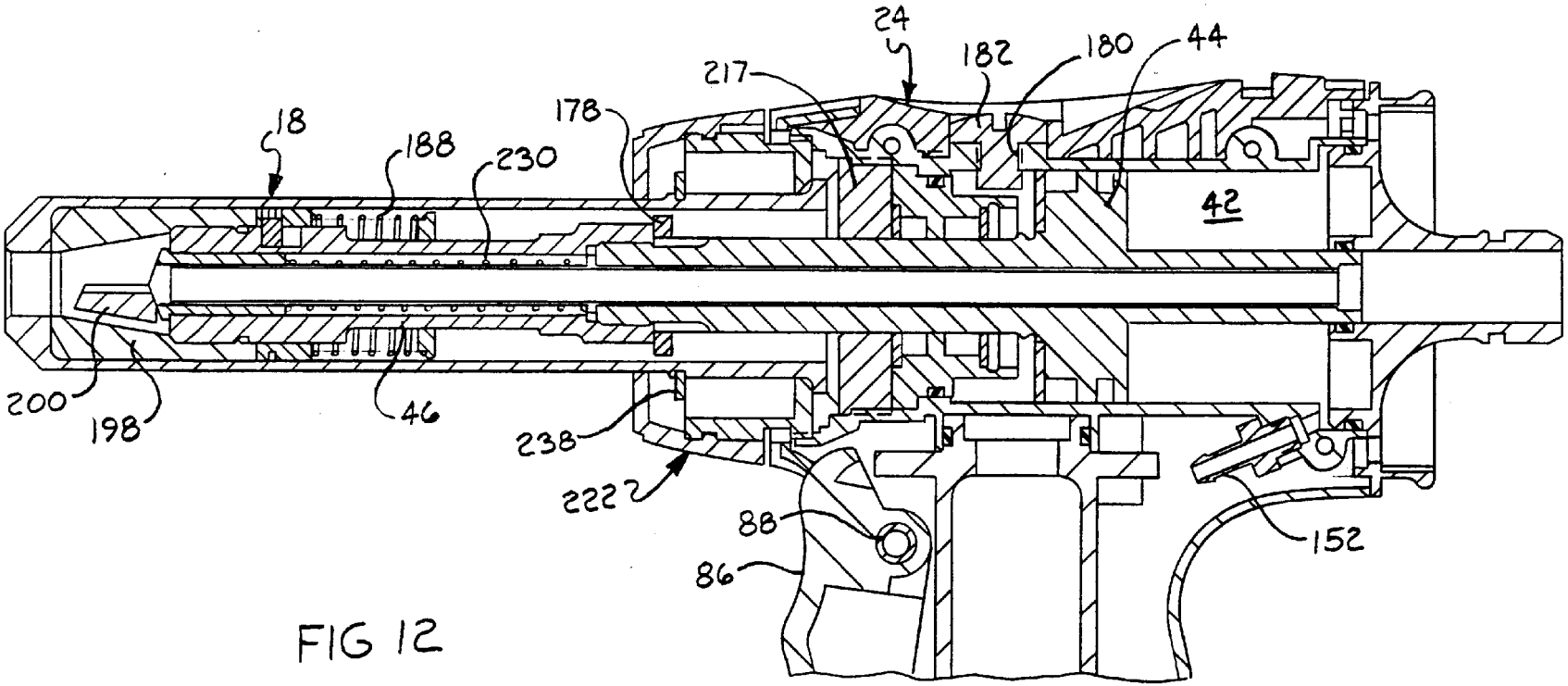
FIG. 12 is a cross sectional view of the nose housing and jaw guide of the present invention with a soft metal damper bushing.

As shown in FIGS. 2 and 12, a brass damper bushing 178 is provided to limit rearward movement of the jaw guide assembly 48 and thus the piston 44. The busing 178 is preferably made of a soft metal such as brass so that impact (shown in FIG. 2) with the pulling head adapter 46 is partially absorbed by the soft metal damper bushing 178. As piston 44 moves into its second position, air in working chamber 42 behind the piston 44 is pushed into the system air through an opening (not shown) which communicates with system inlet 152.

It should be noted that housing 16 maintains an opening 180 which is sealed by a threaded plug 182. Threaded plug 182 can be selectively removed to enable filling of the incompressible fluid through opening 180, into second chamber 42.

Figure 13:
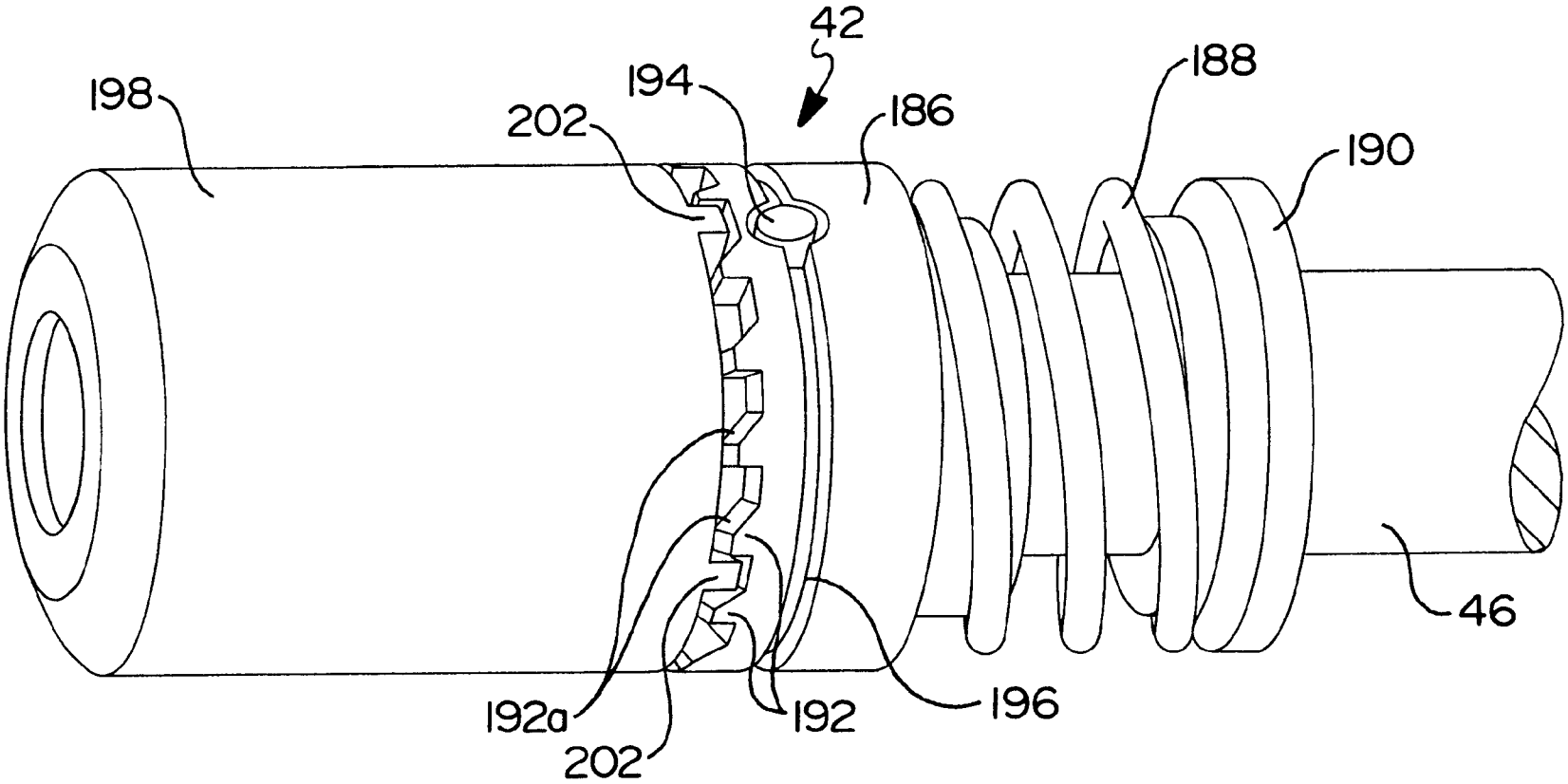
FIG. 13 is a perspective view of a quick connect jaw guide assembly of the rivet setting tool.

With reference to FIGS. 2 and 13, nose housing 18 covers jaw guide assembly 48 which is in communication with piston 44 via pulling head adapter 46. Nose housing 18 also includes a nosepiece 184 which is fixedly attached thereto and receives a mandrel of a rivet (not shown) therethrough. A jaw guide collar 186 is slidably disposed on pulling head adapter 46 and biased in a first direction by a spring 188. Spring 188 seats between jaw guide collar 186 and a flange 190 disposed around pulling head adapter 46. Jaw guide collar 186 is prohibited from rotational motion about pulling head adapter 46 and has extending teeth 192. A pin 194 is disposed through jaw guide collar 186, into pulling head adapter 46, prohibiting rotational movement of the jaw guide collar 186. Pin 194 is held in place by an O-ring (not shown), which seats in a groove 196. A jaw guide 198, supporting a plurality of jaws 200, best shown in FIGS. 2 and 13*a*, is threadedly engaged with pulling head adapter 46 and has extending teeth 202.

The internal threads 204 (best shown in FIG. 14) of the jaw guide 198 are preferably spaced a distance "x" axially away from the teeth 202 sufficiently such that once engaged, the end of the threads 204 stay in engagement with the external threads 206 (FIG. 15) of the pulling head adapter 46. Due to this thread arrangement, debris is prevented from getting into the threads between the jaw guide 198 and the pulling head adapter 198. Thus, the jaw guide quick connect feature is maintained by allowing the jaw guide 198 to be easily removed from the pulling head adapter 46. If the internal threads 204 of the jaw guide 98 were allowed to extend beyond the end of the external threads 206 on the pulling head adapter 46, debris that settles within the internal threads 204 may be allowed to get jammed in the threaded connection between the jaw guide 198 and pulling head adapter 46 and thus prevent the easy removal of the jaw guide 198.

Jaw guide collar 186 and jaw guide 198 have a ratcheting interface therebetween, created by the interaction between teeth 202 and teeth 192, such that jaw guide collar 186 must be pulled out of engagement with jaw guide 198, against the biasing force of spring 188, in order to unscrew jaw guide 198 from pulling head adapter 46. The teeth 192 have a sloped surface 192*a* which, during tightening of the jaw guide 198 onto pulling head adapter 46, cause the teeth 202 to ride up the sloped surface 192*a* and thereby pressing the jaw guide collar 186 against the spring force of spring 188. The jaw guide 198 and jaw guide collar 186 thereby have a ratcheting interface when the jaw guide 198 is tightened onto pulling head adapter 46. FIG. 13 is a perspective view of jaw guide assembly 48 which shows the above discussed ratchet interface. In this manner, jaw guide 198 can be quickly removed and replaced for varying rivet types and/or sizes or for general cleaning and maintenance purposes by pulling back on jaw guide collar 186 and unthreading the jaw guide 198.

Figure 13A:
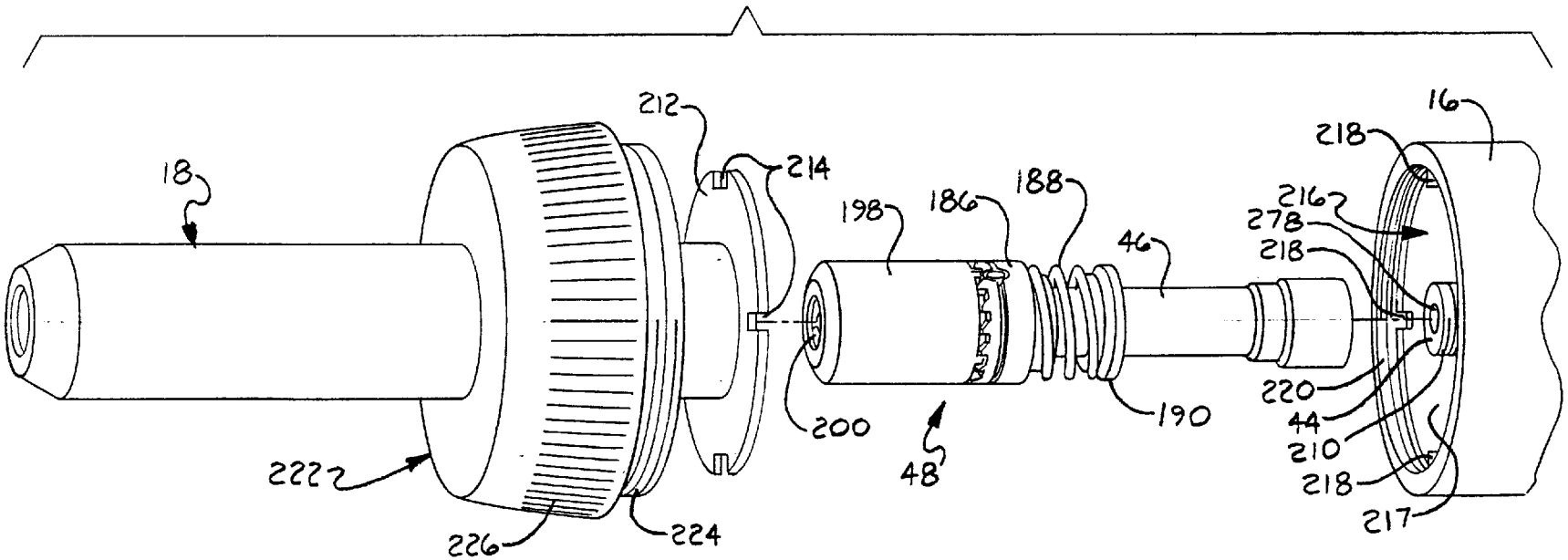
FIG. 13*a* is an exploded perspective view of the quick connect nose housing of the rivet setting tool.

With particular reference to FIG. 13*a*, the assembly of nose housing 18 and jaw guide assembly 48 to housing 16 will be described in detail. Jaw guide assembly 48 is threadably attached to piston 44 on a threaded portion 210 of a cylindrical extension of piston 44. Nose housing 18 slides over jaw guide assembly 48, enclosing jaw guide assembly 48 therein. Nose housing 18 includes a flange 212 having a plurality of notches 214 cut out of a circumferential edge. As nose housing 18 covers jaw guide assembly 48, flange 212 seats within a recess portion 216 against a partition member 217 of housing 16. Recess portion 216 has a plurality of tabs 218 disposed around an outside edge and also includes an internally threaded portion 220. As flange 212 seats within recess portion 216, notches 214 align with tabs 218, such that notches 214 receive tabs 218 therein. As such, nose housing 18 is prohibited from axial rotation by the interface between notches 214 and tabs 218.

A nose knob 222 is included which is slidable on an outside surface of nose housing 18 for holding nose housing 18 in place on housing 16. Nose knob 222 includes an externally threaded portion 224 which interfaces with internally threaded portion 220 of recess portion 216 and has a gripping surface 226 disposed around an outside surface. Using gripping surface 226, an operator can threadably attach nose knob 222 to housing 16 thus holding nose housing 18 tightly in place. As best seen in FIG. 15, a retaining clip 228 is provided on the exterior surface of the nose housing 18 and cooperates with interior flange portion 222*a* to prevent the nose knob 222 from sliding off of the nose housing 18. A plan view of an exemplary retaining clip 228 is shown in FIG. 16.

Prior to a rivet setting operation, piston 44 acts upon a spring 230, best shown in FIGS. 2 and 15, which is disposed within pulling head adapter 46 and around mandrel tube 172. In a normal state, jaws 200 are pushed up against jaw guide 198 by jaw pusher 232 and spring 230. When jaw guide assembly 198 is in a full forward position relative to housing 18, jaws 200 are pushed up against nosepiece 184 (FIG. 2) and retract, also pushing back jaw pusher 232 and compressing spring 230. This allows jaws 200 to open wide enough to allow a rivet mandrel (not shown) to be inserted through nosepiece 184 and received between jaws 200. When the tool is cycled, pulling head adapter 46 pulls back on jaw guide 198. As jaw guide 198 retracts, jaws 200 are forced to squeeze down on the rivet mandrel and at the same time are pushed forward by jaw pusher 232 and spring 230. Teeth on jaws 200 dig into the rivet mandrel and pull backward with the pulling force of piston 44. The rivet mandrel is pulled backward, forcing the rivet body to collapse as the rivet is set in place. The mandrel then breaks and jaw guide assembly 48 returns to the full forward position, forcing jaws 200 open and allowing the spent mandrel to be removed.

Once a rivet setting action has been performed, pressurized air flows into second chamber 42 on the backside of piston 44 through an opening (not shown) which communicates with system inlet 152. This pressurized air assists a reversing process, resetting the rivet setting tool 10 for subsequent rivet setting action. The pressurized air assists piston 44 back to its forward position, subsequently causing piston 44 to again act on spring 230 and jaw pusher 232, thus reopening jaws 200. Also, the substantially incompressible fluid is forced back through opening 64 into first chamber 170 of intensifier 14. In turn, the substantially incompressible fluid forces rod 40 in a downward direction, resetting piston 38 of pneumatic chamber 12. The air remaining inside pneumatic chamber 12 is pushed out through valve module 90, as previously described, as piston 38 moves downward in pneumatic chamber 12.

Figure 17:
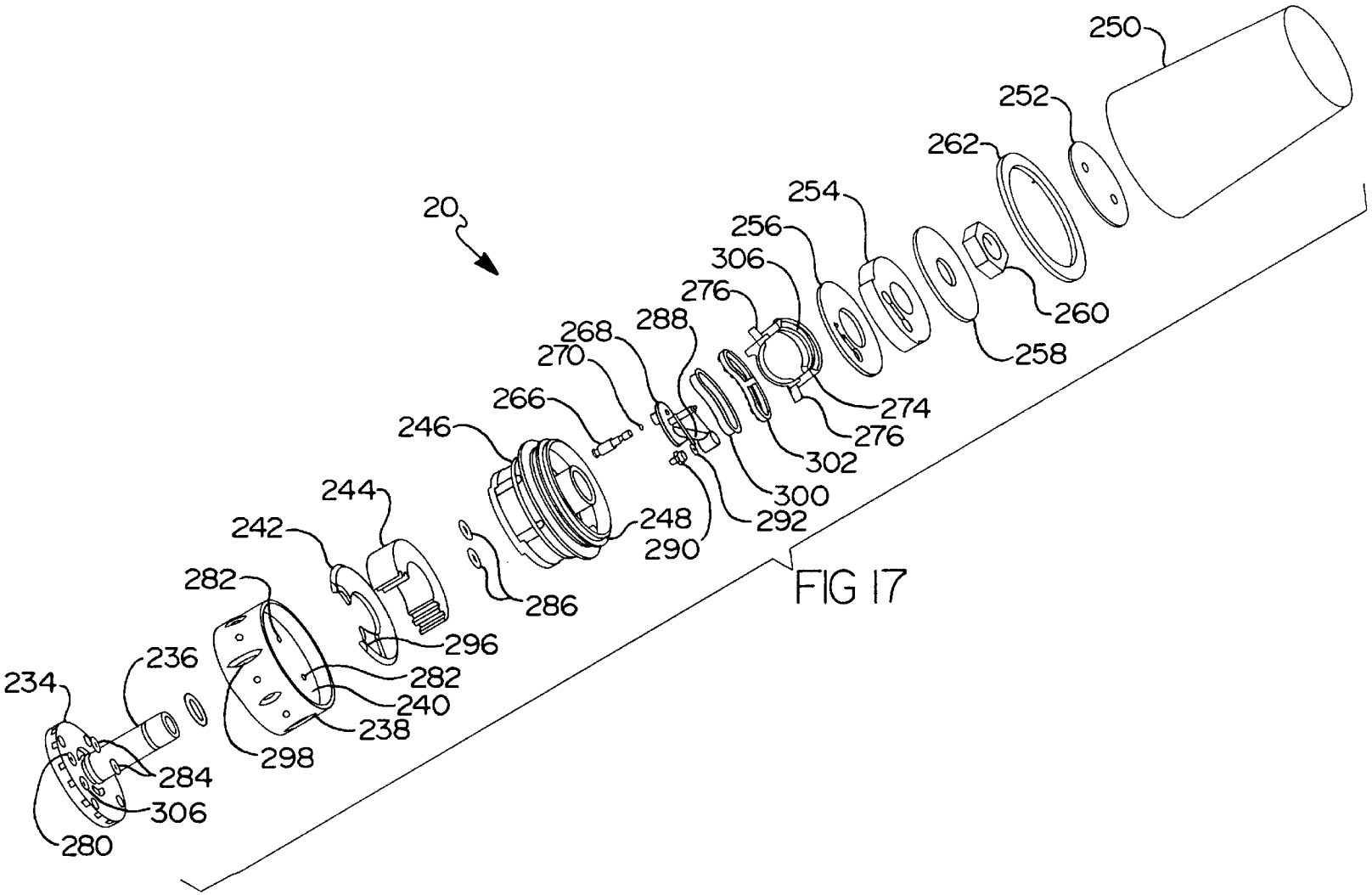
FIG. 17 is an exploded perspective view of a mandrel collection system of the rivet setting tool.

FIG. 17 is an exploded view of mandrel collection system 20 which collects scrap mandrels after a rivet setting operation has occurred. Mandrel collection system 20 includes interface plate 234, which attaches to housing 16. Interface plate 234 includes a cylindrical, hollow stem 236. A control ring 238 mounts onto hollow stem 236, such that it is selectively rotatable therearound. Control ring 238 has a cross plate 240 and enables an operator to select one of three operating modes, discussed in detail below. A muffler cover 242 and muffler 244 are subsequently mounted onto hollow stem 236. An internal ring 246 is included which has a plurality of air passageways, including annular passageways, and mounting structures for various other components. Internal ring 246 has a threaded portion 248. A collection canister 250 is threadedly attached to internal ring 246, interfacing with threaded portion 248. Collection canister 250 collects excess mandrels (not shown) and includes a canister shield 252 for protecting collection canister 250 from incoming mandrels. Mandrel collection system 20 also includes an air filter 254 mounted on an air filter tray 256, within internal ring 246. A cover 258 covers the components disposed within internal ring 246 and is held down by a hex nut 260 which screws onto hollow stem 236. A gasket 262 seals collection canister 250 from atmosphere.

Figure 18:
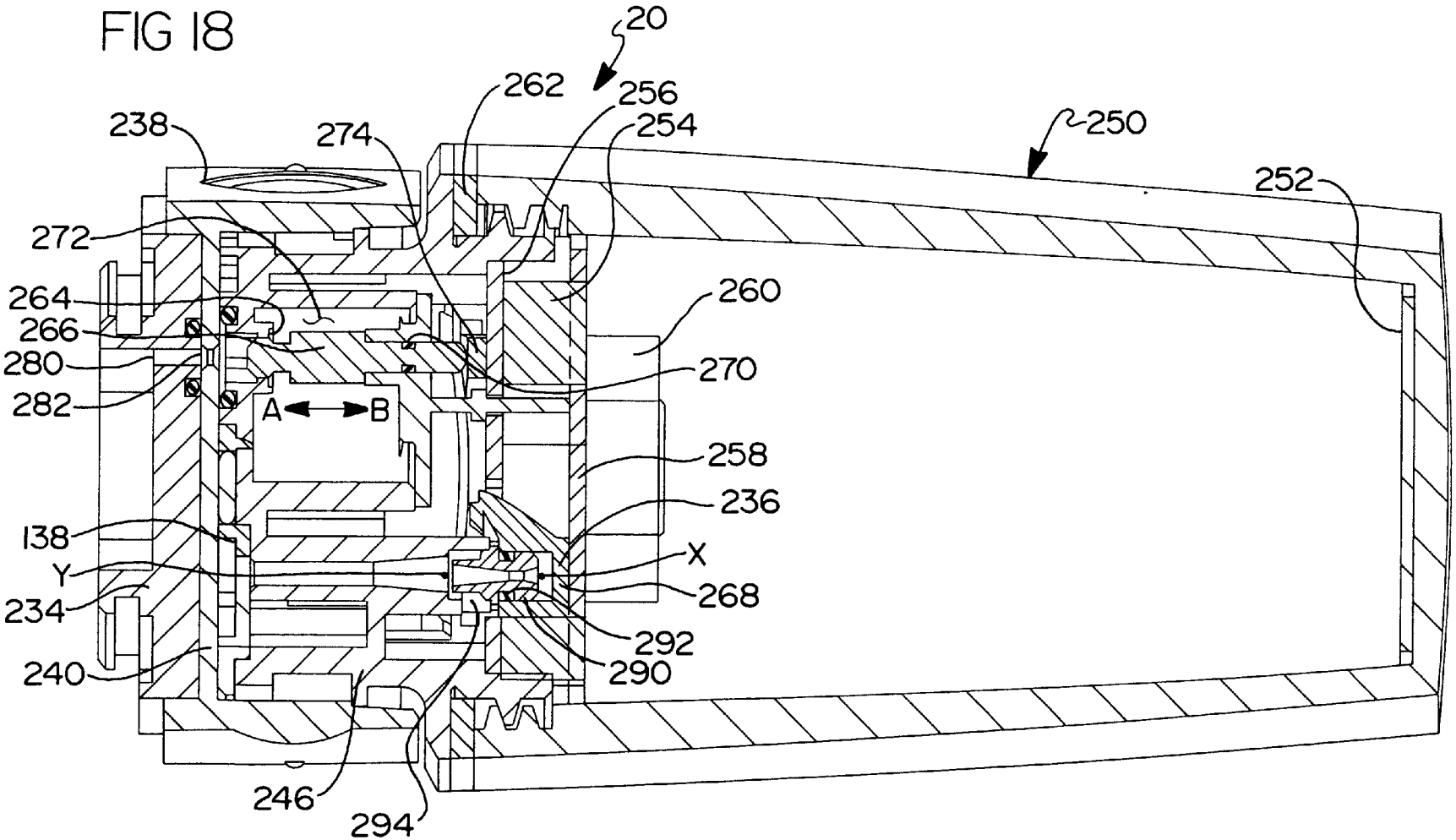
FIG. 18 is a cross sectional view taken offset from the center of the mandrel collection system.

With particular reference to FIG. 18, a cross sectional view offset from the center of mandrel collection system 20 is shown. Internal ring 246 has an opening 264 through which a valve stem 266 is disposed. Valve stem 266 is supported at one end by internal ring 246 and at a second end by the housing of a vacuum venturi transducer 268, seen more fully in FIG. 17. Valve stem 266 includes a recess which receives an O-ring 270 for providing a seal between the housing of the venturi transducer 268 and the valve stem 266 to prevent pressurized air form leaking from annular gap 272 into canister 250. Valve stem 266 is movable in a first direction "A" by a lever 274. Lever 274 is supported within internal ring 246 and is pivotable about arms 276 (see FIG. 17).

Mandrel collection system 20 has three operating modes, "auto", "on" and "off". Each of these modes is operator selectable by rotating control ring 238. Operating mode "auto" produces a high vacuum within collection canister 250 when a rivet is in place in nose housing 18, prior to a rivet setting operation. This vacuum is generated using a "high" setting of system air fed into mandrel collection system 20 through system inlet 152. Once a rivet setting operation has been performed, the mandrel is pulled through mandrel flowpath 278 of mandrel tube 172 (see FIG. 2), as a result of the high vacuum within collection canister 250. After the excess mandrel has been pulled through mandrel flowpath 278, collection canister 250 has an open path of air, through mandrel flowpath 278. As such, air will be continuously drawn, at a high rate, through mandrel flowpath 278 as collection canister 250 tries to again achieve a vacuum. To prevent this continual high draw of air, the "auto" operating mode puts the pressurized gas into a "low" setting until another rivet mandrel is introduced into mandrel flowpath 278. Switching between "high" and "low" settings of the pressurized gas is achieved by manipulating valve stem 266.

Figure 19B:
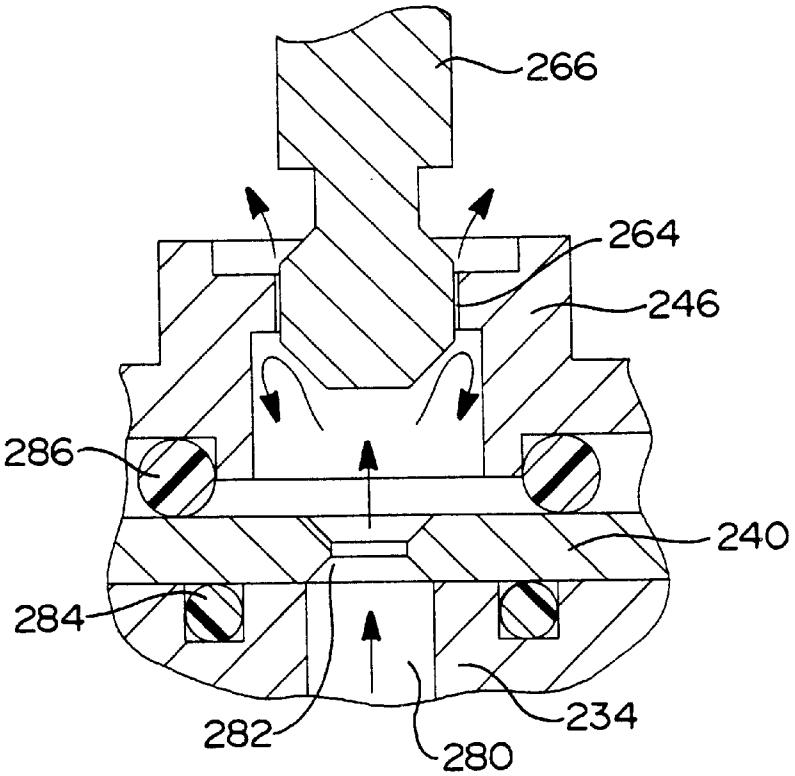
FIGS. 19*a* and 19*b* are detailed cross sectional views of a valve passage and valve stem of the mandrel collection system.
Figure 19A:
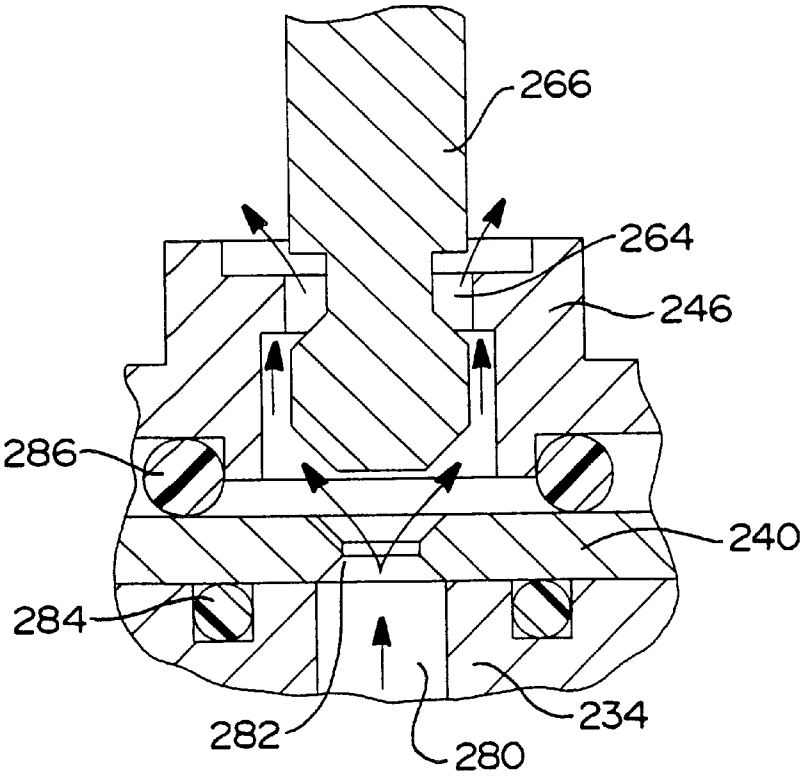

FIGS. 19*a* and 19*b* show detailed views of the interface between valve stem 266 and opening 264 in the "high" and "low" settings, respectively. Interface plate 234 has a first opening 280 for "auto" operation, through which system air from system inlet 152 may flow when control ring 238 is rotated to "auto" mode. Cross-plate 240 of control ring 238 has a plurality of openings 282 which are selectably alignable with opening 280 by rotation of control ring 238. Seals 284, 286 are provided for sealing between interface plate 234 and crossplate 240 as well as internal ring 246 and crossplate 240, respectively. Once openings 280 and 282 are aligned in the "auto" mode, system air from system inlet 152 is able to flow therethrough. In the "high" auto setting, as depicted in FIG. 19*a*, valve stem 266 allows a relatively large amount of pressurized gas to flow through opening 264, as shown by the arrows. In the "low" setting, as depicted in FIG. 19*b*, valve stem 266 blocks a substantial portion of opening 264, allowing for a significantly decreased air flow. Manipulation of valve stem 266, thus switching between "high" and "low" settings, is achieved automatically, in "auto" mode as is described in detail below.

Again referencing FIG. 18, when a rivet is in place within nose housing 18, blocking mandrel flowpath 278, mandrel collection system 20 is operating at a "high" setting. This setting is achieved by pressurized gas flowing through opening 264, as described previously with reference to FIG. 19*b*. Internal ring 246 has an annular gap 272 around valve stem 266. Annular gap 272 enables pressurized gas to flow through an internal passage 288 in the housing of a venturi vacuum transducer 268 (see FIGS. 17 and 18). Venturi vacuum transducer 268 has a venturi jet 290, disposed therein. An O-ring 292 prevents leakage around venturi jet 290. As is known in the art, pressurized airflow through venturi jet 290 at point X (in FIG. 18) accelerates the airflow out of the venturi jet at point Y. As a result, a low pressure area is created at the exit of venturi jet 290. An opening 294, near the low pressure area at point Y, is in communication with the interior of canister 250. As air flows through venturi jet 290, the low pressure created draws air from inside canister 250 through opening 294. The collective air continues down through muffler 244 to muffler cover 242. Muffler cover 242 has a formed recess 296 (see FIG. 17) which allows the collective air to flow out internal ring 246 to atmosphere, through slits 298 in control ring 238. When a rivet setting operation has occurred, the excess mandrel piece is pulled via vacuum force through mandrel flowpath 278, thus leaving mandrel flowpath 278 unobstructed. Once mandrel flowpath 278 is unobstructed, mandrel collection system 20 automatically switches to its "low" setting.

Figure 20B:
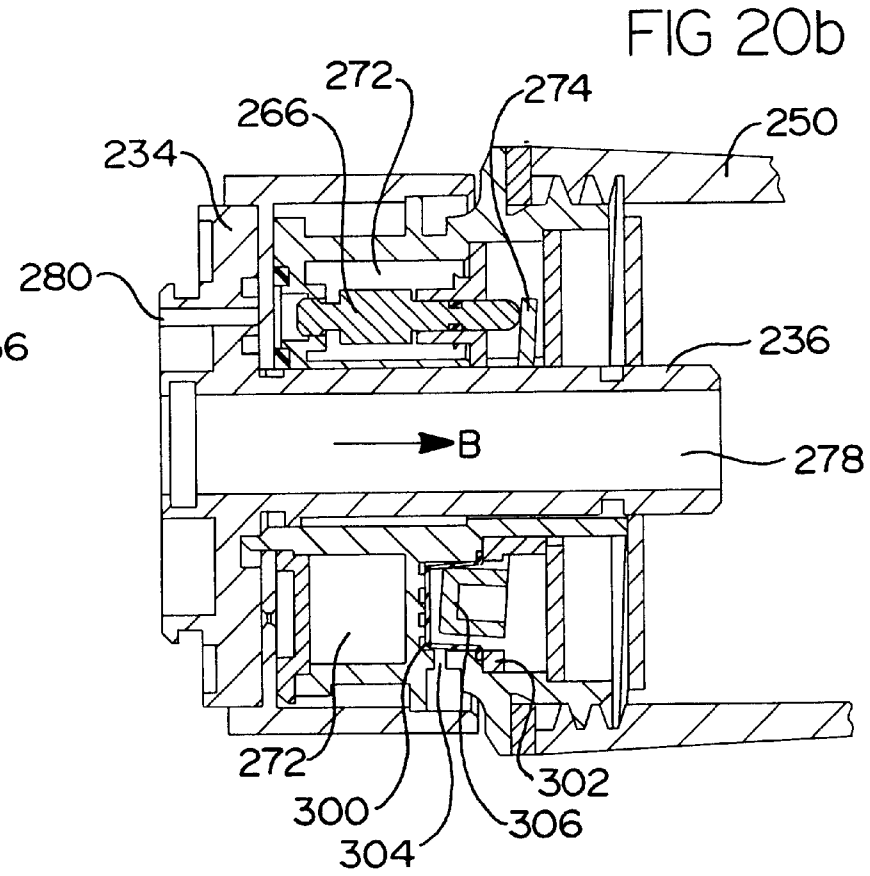
FIGS. 20*a* and 20*b* are cross sectional views taken through the center of the mandrel collection system.
Figure 20A:
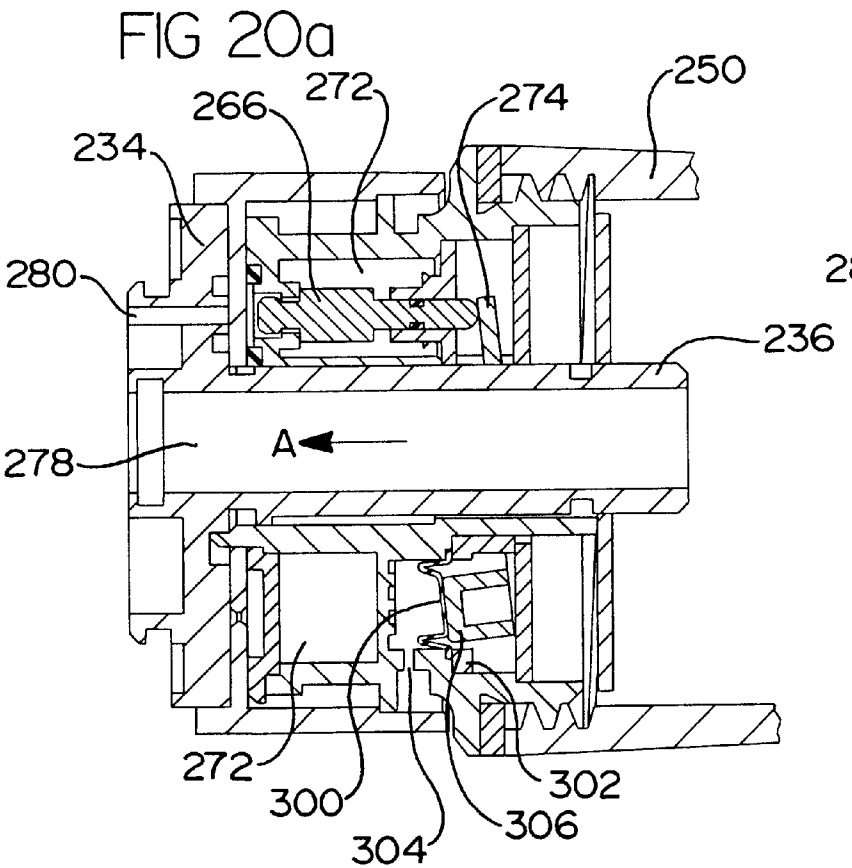

With reference to FIGS. 20*a* and 20*b*, cross sectional views through the center of mandrel collection system 20, switching between "high" and "low" settings is achieved through the implementation of a sensitive diaphragm 300. Diaphragm 300 is active upon lever 274 and is attached to internal ring 246 via a diaphragm retainer 302. Diaphragm 300 is exposed to the internal vacuum of canister 250 on one side and ambient air pressure on the other side through an opening 304. In the "high" vacuum setting, diaphragm 300 is drawn inward toward canister 250 as the result of the vacuum created within canister 250. As diaphragm 300 is drawn toward canister 250, it pushes on a diaphragm interface portion 306 of lever 274. In turn, lever 274 pushes down on valve stem 266, in first direction A, thus freeing airflow through opening 264 (see FIG. 19*a*). Once the excess mandrel is drawn through and mandrel flowpath 278 is unobstructed, the vacuum level in canister 250 decreases and diaphragm 300 retracts to its static position. As a result of the pressurized gas flowing over valve stem 266, through opening 264, valve stem 266 is pushed in a second direction B. In turn, valve stem 266 pushes on lever 274. As a result of valve stem 266 moving in second direction B, opening 264 is substantially closed such that only a small amount of pressurized gas may flow through (see FIG. 19*b*). This small amount of pressurized gas is routed through the housing of venturi transducer 268 and through venturi jet 290, generating a low vacuum. The low vacuum is then used to "sense" when a second rivet (not shown) has been inserted into nose housing 18.

With continued reference to FIGS. 18, 20*a* and 20*b*, inserting a second rivet into nose housing 18 obstructs mandrel flowpath 278. This obstruction causes the vacuum level within canister 250 to increase. The increased vacuum causes diaphragm 300 to again push up on lever 274. As previously described, lever 274 acts on valve stem 266, thus freeing opening 264. As such, the "high" setting is again achieved and mandrel collection system 20 is prepared to provide suction to rapidly pull an excess mandrel through to canister 250.

By sufficiently rotating control ring 238, the "on" mode can be selected. Once in "on" mode, mandrel collection system 20 will continuously draw air through mandrel flowpath 278, regardless of whether or not a rivet is present. In other words, mandrel collection system 20 will be continuously operating at "high". To achieve the "on" mode, valve stem 266 and opening 264 are completely bypassed. Instead, when control ring 238 is rotated to the "on" mode position, opening 282 aligns with a second opening 306 of interface plate 234 (best shown in FIG. 17). Second opening 306 of interface plate 234 communicates directly with annular gap 272 and enables pressurized airflow to continuously act on venturi transducer 268.

Alternatively, an "off" mode is achieved by sufficiently rotating control ring 238. When rotated to "off", opening 282 of control ring 238 is not aligned with either opening 280 or 306 of interface plate 234. As a result, airflow is prohibited from entering mandrel collection system 20, and no vacuum is created within canister 250.

Figure 27:
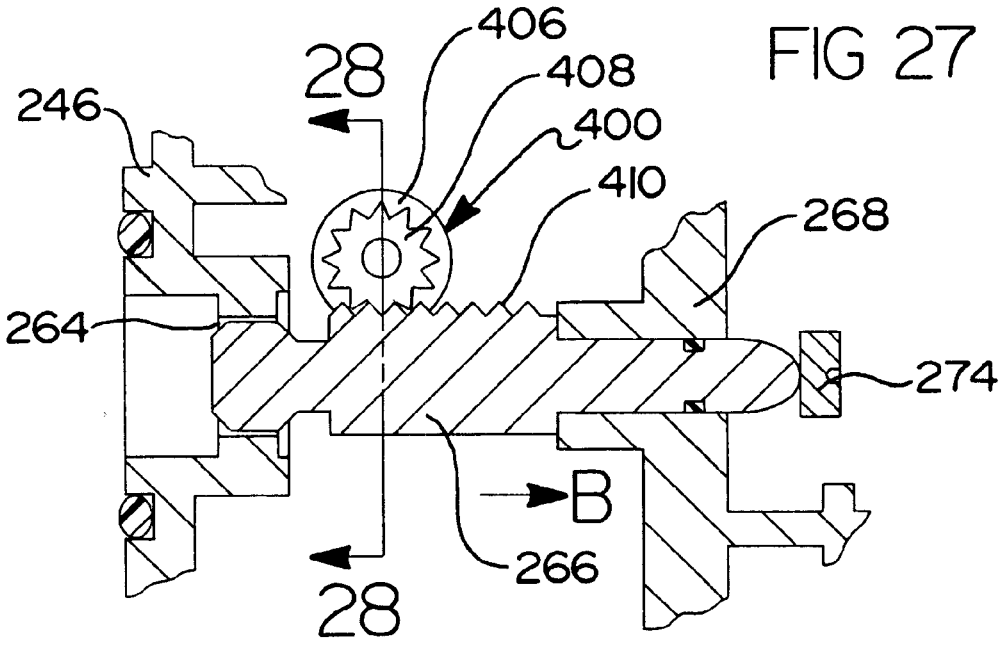
FIG. 27 is a detailed cross sectional view of a dampening system within the mandrel collection system.
Figure 28:
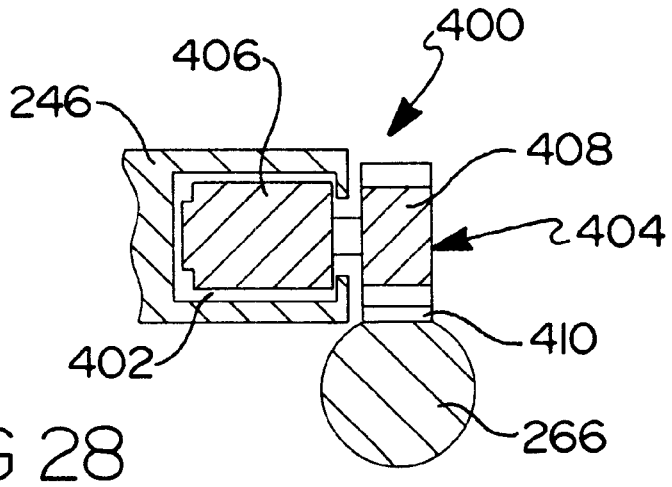
FIG. 28 is a top cross sectional view of the dampening system shown in FIG. 27.

With reference to FIGS. 27 and 28, an optional delay mechanism 400 is shown for implementation with valve stem 266. Delay mechanism 400 serves as a supplement for the "auto" configuration described previously. As such, delay mechanism 400 causes the change between 'high' and 'low' modes to be gradual. Delay mechanism 400 is disposed within internal ring 246 and comprises a cavity 402 having a delay drum 404 rotatably supported therein. Delay drum 404 has a main body portion 406 and pinion gear 408 fixedly connected to one another. Pinion gear 408 mates with a rack portion 410 of valve stem 266. Cavity 402 is filled with a dampening fluid, such as, but not limited to, grease, inhibiting the rotation of the main body portion 406 of delay drum 404. As lever 274 releases pressure on valve stem 266, valve stem 266 is forced in direction B by pressurized air flowing through opening 264. As valve stem 266 moves in direction B, it causes pinion gear 408 to rotate thus causing main body portion 406 to rotate within cavity 402. The dampening fluid within cavity 402 inhibits the rotation of main body portion 406 of delay drum 404. As such, movement of valve stem 266 is dampened as it moves in the direction B. In this manner, opening 264 is prevented from being closed too quickly resulting in a gradual change between 'high' and 'low' modes thus giving additional time for a mandrel in the mandrel tube 172 to be drawn into the collection chamber 250.

Figure 22:
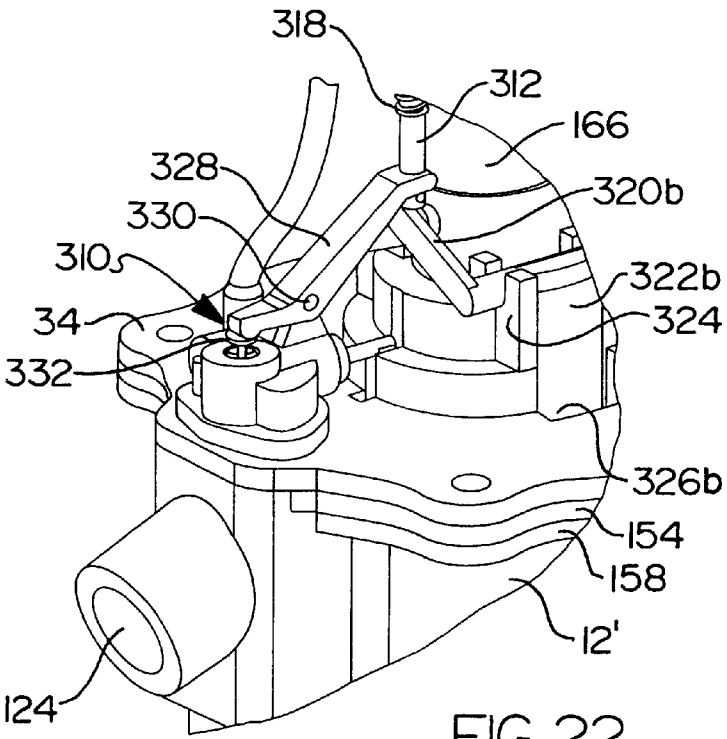
FIG. 22 is a perspective view of the second preferred embodiment, showing a pilot valve assembly.
Figure 21:
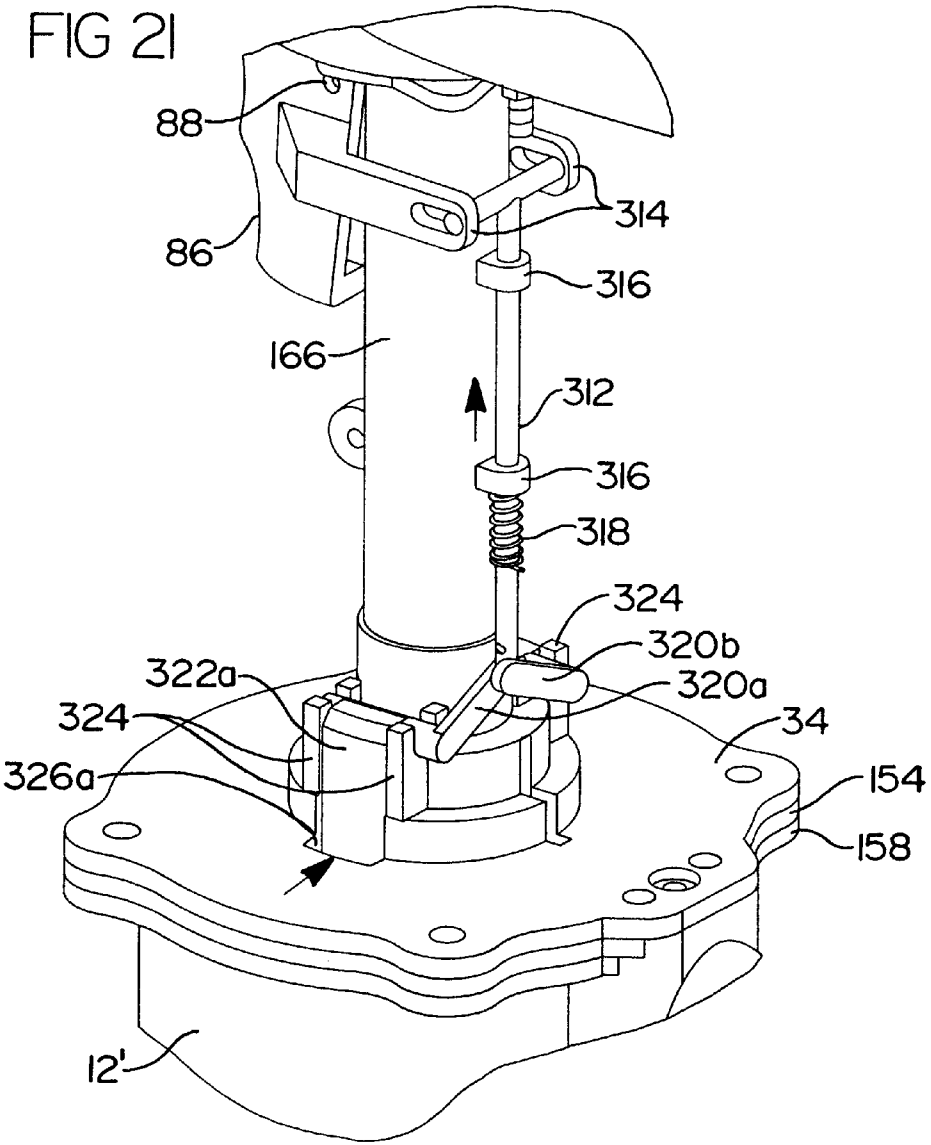
FIG. 21 is a perspective view of a trigger mechanism for a dual piston arrangement according to a second preferred embodiment of the rivet setting tool.

With reference to FIGS. 21–26, a second embodiment of the pneumatic actuation device will be described. In the second preferred embodiment, valve module 90 is removed and a pilot valve module 310 is implemented (as shown in FIG. 22). Trigger 86 is in mechanical communication with a linkage 312 through a pair of arms 314. Linkage 312 runs along the length of intensifier 88 and is slidably held within a pair of guides 184. A spring 318 is concentrically disposed on linkage 312 and acts against one of guides 316 to bias linkage 312 in a downward direction. Linkage 312 is pivotally attached to first and second latch arms 320*a*, 320*b*. First and second latch arms 320*a*, 320*b* are fixedly attached to first and second latches 322*a*, 322*b*. Latches 322*a*,322*b* are pivotally mounted on posts 324 and lead into a top portion of pneumatic chamber 12' through openings 326*a*, 326*b*.

As best seen in FIG. 22, pilot valve module 310 is mounted on top face 34 of pneumatic chamber 12'. Pilot valve module 310 includes a lever 328, which is pivotally attached to a mount 330, and a valve spool 332. Lever 328 is pivotally attached to linkage 312 at a first end and in mechanical communication with the valve spool 332 at a second end. When trigger 86 is pulled, linkage 312 moves in an upward direction against the biasing force of spring 318. Linkage 312 pulls upward on latch arms 320*a*, 320*b*, thus pivoting latches 322*a*, 322*b* from a disengaged position to an engaged position. Additionally, linkage 312 pulls upward on lever 328 causing lever 328 to pivot and push downward on valve spool 332.

Figure 23A:
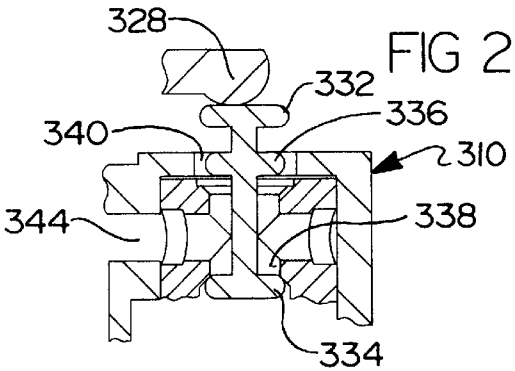
FIG. 23*a* is a detailed cross sectional view of the pilot valve assembly.
Figure 23:
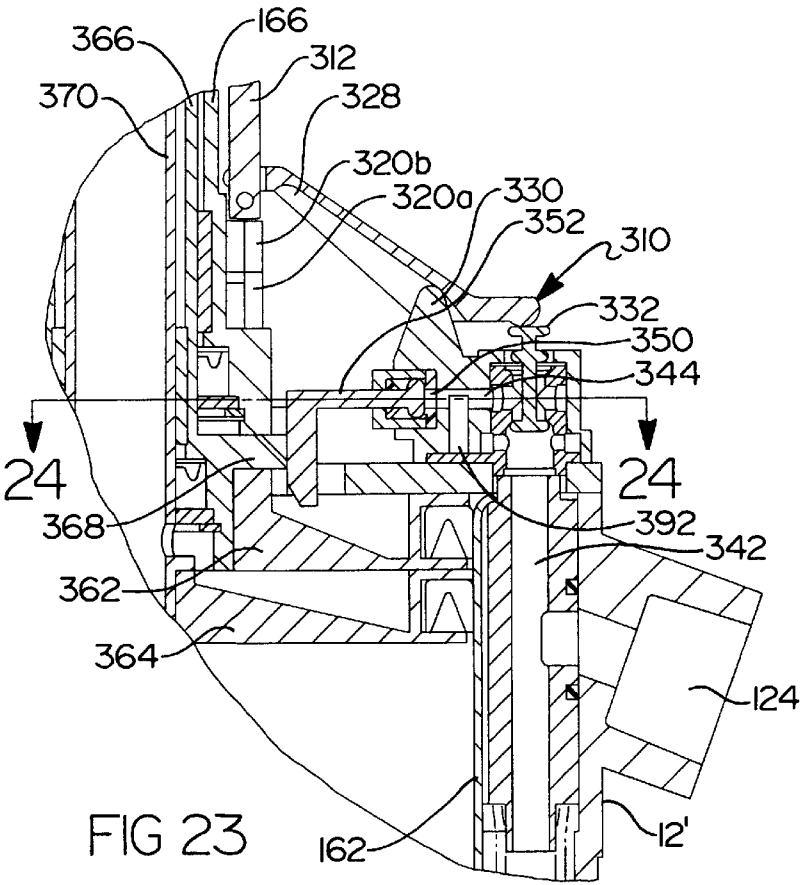
FIG. 23 is a partial cross sectional view of the second preferred embodiment including the pilot valve assembly.

FIG. 23 is a detailed cross sectional view of a portion of pneumatic chamber 12' and pilot valve module 310 through their respective centers. FIG. 23*a* is a detailed view of valve spool 332 within pilot valve module 310. Valve spool 332 includes first and second blockers 334, 336. First blocker 334 obstructs a first airflow passage 338 when valve spool 332 is in an initial position. Valve spool 332 is biased upwards, into the initial position by pressurized air. In this initial position, a second airflow passage 340 is unobstructed by second blocker 336. As described above, pulling on trigger 86 causes lever 228 to push downward on valve spool 332. As a result, valve spool 332 moves to a second position with first blocker 334 opening first airflow passage 338 and second blocker 336 obstructing second airflow passage 340. As such, pressurized airflow from pressurized air source interface 124 flows into a first airflow channel 342 (see FIG. 23), and subsequently through first airflow passage 338 into a second airflow channel 344.

With reference to FIG. 24, a cross-sectional view of pilot valve module 310, along line 24—24 of FIG. 23, is shown. Second airflow channel 344 is in communication with a third airflow channel 346. Additionally, second airflow channel 344 is in communication with a sensor chamber 348 through passage 350. A sensor valve 352 is also included which is partially disposed, at one end, within sensor chamber 348. Sensor valve 352 is slidable within a slot 354 in first and second directions A,B for selectively obstructing passage 350. A vent passage 356 exists as a small gap between sensor valve 352 and sensor chamber 348. Vent passage 356 is initially obstructed by valve sensor 352 when valve sensor 352 is fully positioned in the A direction. However, vent passage 356 becomes unobstructed when valve sensor 352 is positioned in the B direction. Sensor chamber 348 is in communication with a fourth airflow channel 358 through an opening 360.

Figure 25:
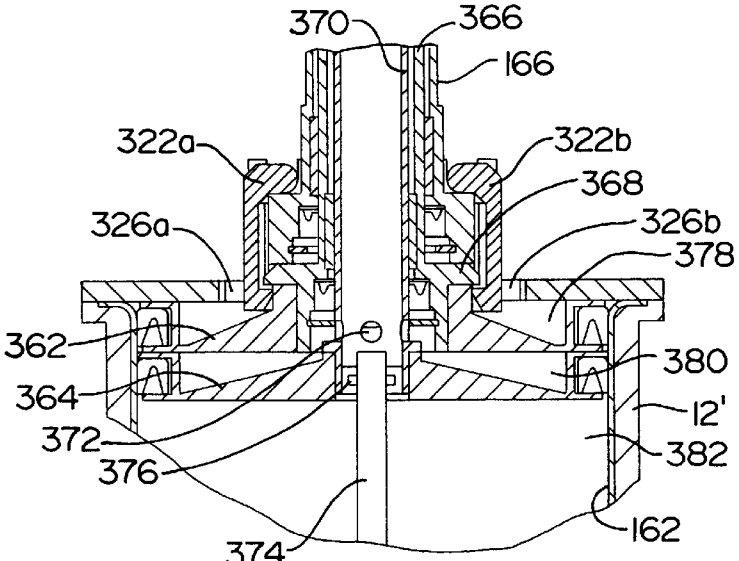
FIG. 25 is a partial cross sectional view of a pneumatic chamber including the dual piston arrangement of the second preferred embodiment.

With reference to FIG. 25, the second preferred embodiment of the pneumatic actuation device includes concentrically disposed first and second pistons 362, 364. First piston 362 is connected to a first ram 366 through a flange 368. Ram 366 is disposed within and slidable along intensifier 166. Second piston 364 is connected to a second ram 370 which is concentrically disposed within and slidable along first ram 366. Second ram 370 is hollow and includes a plurality of openings 372 disposed around a bottom end. An intermediate air tube 374 runs through second piston 364 and is concentrically disposed within second ram 370. An O-ring seal 376 is disposed between second piston 364 and intermediate air tube 374 such that second piston 364 is slidable along intermediate air tube 374 without allowing airflow therebetween. Pneumatic chamber 12' is divided into first, second and third chamber portions 378,380,382. First chamber portion 378 is defined as the area between the top of pneumatic chamber 12' and first piston 362. Second chamber portion 380 is defined as the area between first piston 362 and second piston 364. Third chamber portion 382 is defined as the area between second piston 230 and the bottom of pneumatic chamber 12'. First chamber portion 378 is open to atmosphere through openings 326*a*, 326*b*. Intermediate air tube 374 is in communication with second chamber portion 380 through openings 372 in second ram 370.

With reference to FIGS. 26*a* and 26*b*, a valve module 384 is disposed beneath pneumatic chamber 12'. Valve module 384 includes an upper air piston valve 386 and a lower air piston valve 388. Upper air piston valve 386 and lower air piston valve 388 control pressurized airflow to second and third chamber portions 390,392, respectively. Upper air piston valve 386 is in communication with intermediate air tube 374. Also, upper air piston valve 386 is in communication with fourth airflow channel 358, of pilot valve module 310, through a first air line 390. Lower air piston valve 388 is in communication with third airflow channel 348 of pilot valve module 310 through a second air line 392. Although not shown, first and second air lines 390,392 run below pneumatic chamber 12' and curve upward, parallel to first airflow channel 342, to connect with pilot valve module 310. First airflow channel 342 is in communication with both upper and lower piston valves 386,388.

With reference to FIGS. 23 through 26*b*, operation of the second preferred embodiment of rivet setting tool 10 will be described. Initially, both first and second pistons 362,364 are positioned at the bottom of pneumatic chamber 12', latches 322*a*, 322*b* are in a disengaged position and sensor valve 352 is positioned in the A direction, leaving opening 350 unobstructed. Pressurized air is supplied directly to both upper and lower piston valves 386,388, through first airflow channel 342. Both upper and lower piston valves 386,388 remain in a closed position as a result of the pressurized air through first airflow channel 342.

When trigger 86 is pulled, latches 322*a*,322*b* pivot inward into an engaged position. As described earlier, valve spool 332 is pressed downward by lever 328, thus obstructing second airflow passage 340 and opening first airflow passage 338. As such, pressurized air through first airflow channel 342 is able to travel upward through first airflow passage 338, relieving pressure on upper and lower piston valves 386,388. The pressurized air flowing through first airflow passage 338 continues through second airflow channel 344. Within second airflow channel 344 the pressurized air splits, with a first portion of the pressurized air flowing through unobstructed opening 350, into sensor chamber 348. A second portion of pressurized air travels through third airflow passage 346, into second air line 392. From sensor chamber 348 the first portion of pressurized air continues through opening 360 into fourth airflow channel 358 and onwards into first air line 390. The first portion of pressurized air in first air line 390 pushes on upper piston valve 386 and the second portion of pressurized air in second air line 392 pushes on lower piston valve 388. In response, both upper and lower piston valves 386,388 open as there is no longer opposing pressure through first air channel 342. The first portion of pressurized air flows through upper piston valve 252 into intermediate air tube 374 and into second chamber portion 380, through openings 372. The second portion of pressurized air flows through lower piston valve 388 and into third chamber portion 382.

The first portion of pressurized air, within second chamber portion 380, forces first piston 362 upwards and holds second piston 364 down. First piston 362 is able to move upwards as first chamber portion 378 is open to-atmosphere through openings 326*a*,326*b*. Any air present in first chamber portion 378 will be forced out through openings 326*a*, 326*b*, as first piston 362 travels upward. As first piston 362 reaches the top of pneumatic chamber 12, flange 368 performs two functions. Initially, flange 368 pushes into and engages latches 322*a*,322*b*, as best shown in FIG. 25. As such, latches 322*a*,322*b* hold flange 368 in position and prohibit downward motion of first piston 362. Also, flange 368 pushes into an end of sensor valve 352 (best shown in FIG. 23), forcing sensor valve 352 sufficiently in the B direction to obstruct opening 350. With opening 350 obstructed, the first portion of pressurized air is prohibited from flowing through first air line 390 to upper piston valve 386 and second chamber portion 380. Additionally, when sensor valve 352 moves to obstruct opening 350, second chamber portion 380 vents to atmosphere through unobstructed vent passage 356 (FIG. 24), relieving air pressure between first piston 362 and second piston 364. With the air pressure in second chamber portion 380 relieved, second piston 364 is able to move upward as pressurized air is supplied into third chamber portion 382 through lower piston valve 388. Second piston 364 travels upward until hitting the bottom of first piston 362.

First and second rams 366,370 act within intensifier 166 analogously to ram 40 of the first preferred embodiment by displacing the generally incompressible fluid in the intensifier to achieve the rivet setting action through to jaw guide assembly 48. Therefore, further explanation is not required. It is important to note, however, that first ram 366 initially displaces a sufficient amount of hydraulic fluid within first chamber 170. Subsequently, second ram 370 displaces enough of the remaining hydraulic fluid within first chamber 170 to complete the full riveting action of rivet 10. The dual ram/dual piston design therefore achieves the same riveting action as a single ram/single piston design with a the dual RAM/dual piston design having a smaller pneumatic chamber. The diameter of first and second pistons 362,364 as well as the size of pneumatic chamber 12' is able to be reduced and the length of travel is also decreased in comparison to a single piston/single ram design. This results in easier use by the operator.

Upon completion of the rivet setting action, the operator releases trigger 86 thus relieving downward pressure on valve spool 332 and opening latches 322*a*,322*b*. First and second rams 366,370 are pushed downward similarly to ram 40 of the first preferred embodiment. As first and second pistons 362,364 return downward, the air within second and third chamber portions 380,382 vents back through upper and lower piston valves 386,388. The vented air flows through first and second air lines 390,392 into pilot valve module 310. Since flange 368 is no longer pressing on sensor valve 352, sensor valve 352 is free to open. As such, the air can be vented back through pilot valve module. 310 and out to atmosphere through second airflow passage 340. Second airflow passage 340 is unobstructed because the pressurized air through first airflow channel 342 again biases valve spool 332 upward. The rivet setting tool is then reset and ready for a subsequent rivet setting action.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rivet setting tool, comprising:

a pulling head member adapted to be connected to a piston at one end; and a jaw guide assembly including a jaw guide member threadedly connected to said pulling head member for movement therewith, a jaw guide collar slidably disposed on said pulling head member and biased relative thereto in a first direction by a spring member, said jaw guide member supporting a plurality of jaw members, said jaw guide collar and said jaw guide member forming a ratcheting interface therebetween whereby said jaw guide collar must be pulled, against a biasing force of said spring, out of engagement with said jaw guide member in order to unscrew said jaw guide member from said pulling head member, wherein upon screwing said jaw guide member onto said pulling head member, said jaw guide collar ratchets back under spring load.

2. The rivet setting tool according to claim 1, wherein said jaw guide collar includes a slot which receives a guide element that is engaged with said pulling head member to prevent said jaw guide collar from rotating relative to said pulling head member.

3. The rivet setting tool according to claim 1, wherein said pulling head member includes a spring seat against which said spring is disposed.

4. The rivet setting tool according to claim 1, wherein said jaw guide collar includes a plurality of ratcheting teeth and said jaw guide member includes a plurality of projections which engage said ratcheting teeth.

5. The rivet setting tool according to claim 4, wherein said plurality of ratcheting teeth include an inclined surface on one side thereof.

6. The rivet setting tool according to claim 4, wherein said jaw guide member includes internal threads for connection to external threads of said pulling head member, said internal threads of said jaw guide member being spaced longitudinally from said plurality of projections such that an end of said internal threads closest to said projections is incapable of extending beyond an end of the external threads of said pulling head member when said pulling head member and said jaw guide member are threadedly engaged.

7. The rivet setting tool according to claim 1, further comprising a housing for enclosing said jaw guide assembly.

8. A rivet setting tool, comprising:

a housing member;

a pulling head assembly including a piston disposed within a cylinder and operative for actuating a plurality of jaw members to apply an axial pulling force to a mandrel of a rivet;

a jaw guide assembly for supporting said plurality of jaw members;

a nose housing mounted to said housing member and receiving said jaw guide assembly, said nose housing interfacing with said housing member with anti-rotation elements; and a nut assembly including a threaded portion threadedly engaging said housing member and securing said nose housing to said housing member.

9. The rivet setting tool according to claim 7, wherein said anti-rotation elements include at least one tab on one of said housing member and said nose housing that engages at least one slot on the other of said housing member and said nose housing.

10. The rivet setting tool according to claim 7, wherein said nut assembly includes a hand grip portion fixed to said threaded portion.

11. The rivet setting tool according to claim 7, wherein said nose housing includes a flange portion at one end thereof which is secured between said nut assembly and said housing member.

12. The rivet setting tool according to claim 7, wherein said nut assembly is retained on said nose housing by a retainer clip.

* * * * *